US010655866B2

(12) United States Patent
Ha et al.

(10) Patent No.: US 10,655,866 B2
(45) Date of Patent: May 19, 2020

(54) COOKING APPARATUS AND CONTROLLING METHOD THEREOF

(71) Applicant: SAMSUNG ELECTRONICS CO., LTD., Suwon-si, Gyeonggi-do (KR)

(72) Inventors: Joo-Young Ha, Suwon-si (KR); Boo Keun Yoon, Yongin-si (KR); Yong Jong Park, Seongnam-si (KR); Jong Sung Park, Seoul (KR); Ji-Young Lee, Yongin-si (KR); Jeong Su Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 431 days.

(21) Appl. No.: 15/378,836

(22) Filed: Dec. 14, 2016

(65) Prior Publication Data

US 2017/0343220 A1 Nov. 30, 2017

Related U.S. Application Data

(60) Provisional application No. 62/343,197, filed on May 31, 2016, provisional application No. 62/345,079, filed on Jun. 3, 2016.

(30) Foreign Application Priority Data

Jul. 12, 2016 (KR) ..... 10-2016-0087941

(51) Int. Cl.
*A21B 1/00* (2006.01)
*F24C 15/22* (2006.01)
(Continued)

(52) U.S. Cl.
CPC ..... *F24C 15/22* (2013.01); *F24C 7/043* (2013.01); *F24C 7/046* (2013.01); *F24C 7/087* (2013.01)

(58) Field of Classification Search
CPC .. F24C 15/22; F24C 7/04; F24C 7/043; F24C 7/046; F24C 7/06; F24C 7/062; F24C 7/065; F24C 7/067; F24C 7/087
(Continued)

(56) References Cited

U.S. PATENT DOCUMENTS 4,548,691 A * 10/1985 Dietrich ..... C03C 17/36 204/192.27
4,892,997 A * 1/1990 McWilliams ..... H05B 3/744 219/448.11
(Continued)

FOREIGN PATENT DOCUMENTS

CN 101152049 4/2008
CN 205144281 4/2016
(Continued)

OTHER PUBLICATIONS

Chinese Office Action dated Apr. 17, 2019 in Chinese Patent Application No. 201710400562.9.
(Continued)

*Primary Examiner* — Sang Y Paik
(74) *Attorney, Agent, or Firm* — Staas & Halsey LLP

(57) ABSTRACT

Disclosed herein is a cooking apparatus capable of cooking a plurality of cooking materials using a heat transfer regulator having a plurality of regions in which a reflectance against heat generated by a heater is variable, and a controlling method thereof. In accordance with one aspect of the present disclosure, a cooking apparatus includes at least one heater and a heat transfer regulator provided to face the at least one heater and provided with a plurality of regions each having a different reflectance against heat generated by the at least one heater.

14 Claims, 23 Drawing Sheets

(51) Int. Cl.
*F24C 7/08* (2006.01)
*F24C 7/04* (2006.01)

(58) Field of Classification Search
USPC ..... 219/391–393, 399, 402–405, 219/449.1–452.13; 126/683–700
See application file for complete search history.

(56) References Cited

U.S. PATENT DOCUMENTS

| | | | | |
|---|---|---|---|---|
| 5,183,997 | A * | 2/1993 | Lotz | C03C 17/3482 219/460.1 |
| 6,069,345 | A * | 5/2000 | Westerberg | A47J 37/0623 219/411 |
| 2017/0074522 | A1 * | 3/2017 | Cheng | F24C 7/085 |

FOREIGN PATENT DOCUMENTS

| | | |
|---|---|---|
| EP | 2618634 A1 | 7/2013 |
| EP | 2648479 A1 | 10/2013 |
| EP | 2983452 | 2/2016 |
| JP | 2006-286373 | 10/2006 |
| JP | 2010-35985 | 2/2010 |
| JP | 2010-127492 | 6/2010 |
| KR | 20-1999-0023550 | 7/1999 |
| KR | 1999-0082618 | 11/1999 |
| KR | 2000-0018015 | 4/2000 |
| KR | 10-2006-0013843 | 2/2006 |
| KR | 10-1473687 | 12/2014 |

OTHER PUBLICATIONS

International Search Report dated Aug. 30, 2017 in International Patent Application No. PCT/KR2017/005494.
Extended European Search Report dated Aug. 24, 2017 in European Patent Application No. 16203762.6.
European Office Action dated Dec. 18, 2019 from European Patent Application No. 16203762.6, 5 pages.
Chinese Office Action dated Dec. 20, 2019 from Chinese Patent Application No. 201710400562.9, 9 pages.

* cited by examiner

COOKING APPARATUS AND CONTROLLING METHOD THEREOF

CROSS-REFERENCE TO RELATED APPLICATION(S)

This application claims the benefit of Korean Patent Application No. 102016-0087941, filed on Jul. 12, 2016 in the Korean Intellectual Property Office, U.S. Provisional Patent Application No. 62/343,197, filed on May 31, 2016, and No. 62/345,079, filed on Jun. 3, 2016, the disclosure of each of which is incorporated herein by reference.

BACKGROUND

1. Field

Embodiments of the present disclosure relate to a cooling apparatus.

2. Description of Related Art

A cooking apparatus is typically configured to cook a single type food at one time.

When a plurality of foods requiring a different cooking temperature and cooking time is cooked at one time using a conventional cooking apparatus, there may occur some problems, i.e., any food is less cooked and other food is over cooked.

Therefore, in order to properly cook a variety of foods which require a different cooking temperature, a different cooking time and a different recipe using a conventional cooking apparatus, a long cooking time may be needed since each single food is cooked at a time. Accordingly, there has been an attempt of developing a cooking apparatus configured to cook a variety of foods requiring a different cooking temperature and time, and a different recipe at one time so as to reduce a cooking time and energy.

SUMMARY

Therefore, it is an aspect of the present disclosure to provide a cooking apparatus capable of cooking a plurality of cooking materials using a heat transfer regulator having a plurality of regions in which a reflectance against heat generated by a heater is variable, and a controlling method thereof.

Additional aspects of the present disclosure will be set forth in part in the description which follows and, in part, will be obvious from the description, or may be learned by practice of the present disclosure.

In accordance with one aspect of the present disclosure, a cooking apparatus comprising: at least one heater; and a heat transfer regulator provided to face the at least one heater and provided with a plurality of regions each having a different (respective) reflectance against heat generated by the at least one heater.

The heat transfer regulator further comprises a reflector provided in a boundary between the plurality of regions of the heat transfer regulator to reflect an incident electromagnetic wave to prevent an interference of electromagnetic waves, which are generated by the heater and pass through the plurality of regions.

The heat transfer regulator further comprises a reflector protruded with a predetermined length in a boundary between the plurality of regions in a surface that is opposite to a surface facing the at least one heater.

The heat transfer regulator comprises the plurality of regions placed to be spaced apart from each other, and a reflector protruded with a predetermined length toward a surface, which is opposite to a surface facing the at least one heater, in the separated space to prevent a heat conduction between the plurality of regions.

The heat transfer regulator comprises a coating layer provided in each of the plurality of regions and configured to have a different reflectance, wherein the coating layer is provided on at least one surface between a surface facing the at least one heater and a surface that is opposite to the surface facing the at least one heater.

The plurality of regions of the heat transfer regulator comprises a glass each having a different (respective) reflectance.

The plurality of regions of the heat transfer regulator comprises a lens having a convex shape, in which a surface opposite to a surface facing the at least one heater has a convex shape.

The cooking apparatus further comprises: a sensor configured to detect a cooking state of cooking material, wherein the sensor comprises at least one of an infrared sensor detecting a temperature of the cooking material, a gas sensor detecting a gas generated in the cooking material and a camera acquiring an image of the cooking material.

The cooking apparatus further comprises: a controller configured to control an operation of the at least one heater according to a change in the cooking state of the plurality of cooking materials cooked by heat applied via the heat transfer regulator.

A bottom surface of the cooking apparatus comprises a plurality of regions in which a cooking material is placed, wherein the plurality of regions of the bottom surface has a different heat absorption rate.

The plurality of regions of the bottom surface corresponds to the plurality of regions of the heat transfer regulator.

The plurality of regions of the bottom surface is spaced apart from each other to prevent a heat conduction therebetween.

The bottom surface comprises a material having a lower heat conductivity than a predetermined reference value, in the separated space to prevent the heat conduction between the plurality of regions of the bottom surface.

The cooking apparatus further comprises: a lower reflection device provided in a lower side of the bottom surface of the cooking apparatus and provided with a plurality of regions corresponding the plurality of regions, wherein the plurality of regions of the lower reflection device has a different heat reflectance.

The heat transfer regulator comprises at least one first region blocking electromagnetic waves generated by the at least one heater and at least one second region passing through the electromagnetic waves generated by the at least one heater.

The at least second region comprises a plurality of holes so that the electromagnetic waves pass therethrough.

The at least one first region is provided to adjust an area thereof such that when an area of the first region is increased, an area of the second region adjacent to the increased area of the first region is reduced, and when an area of the first region is reduced, an area of the second region adjacent to the reduced area of the first region is increased.

In accordance with one aspect of the present disclosure, a control method of a cooking apparatus comprising: identifying cooking materials by a sensor of a cooking apparatus; determining an expected operation time and output of a plurality of heaters for cooking the identified cooking materials; determining any one expected operation time among the expected operation times as an operation time of the plurality of heaters; and controlling the determined output of the plurality of heaters based on the determined operation time of the plurality of heaters.

The determination of any one expected operation time among the expected operation times as an operation time of the plurality of heaters comprises determining the maximum expected operation time among the determined expected operation time, as an operation time of the plurality of heaters, and the control of the determined output of the plurality of heaters based on the determined operation time of the plurality of heaters comprises, when the heater among the plurality of heaters has a shorter operation time than the determined maximum operation time, controlling an output of the heater to be lower than the determined output.

The determination of any one expected operation time among the expected operation times as an operation time of the plurality of heaters comprises determining the minimum expected operation time among the determined expected operation time, as an operation time of the plurality of heaters, and the control of the determined output of the plurality of heaters based on the determined operation time of the plurality of heaters comprises, when the heater among the plurality of heaters has a longer operation time than the determined minimum operation time, controlling an output of the heater to be higher than the determined output.

BRIEF DESCRIPTION OF THE DRAWINGS

These and/or other aspects of the disclosure will become apparent and more readily appreciated from the following description of embodiments, taken in conjunction with the accompanying drawings of which.

DESCRIPTION OF EMBODIMENTS

Figure 1:
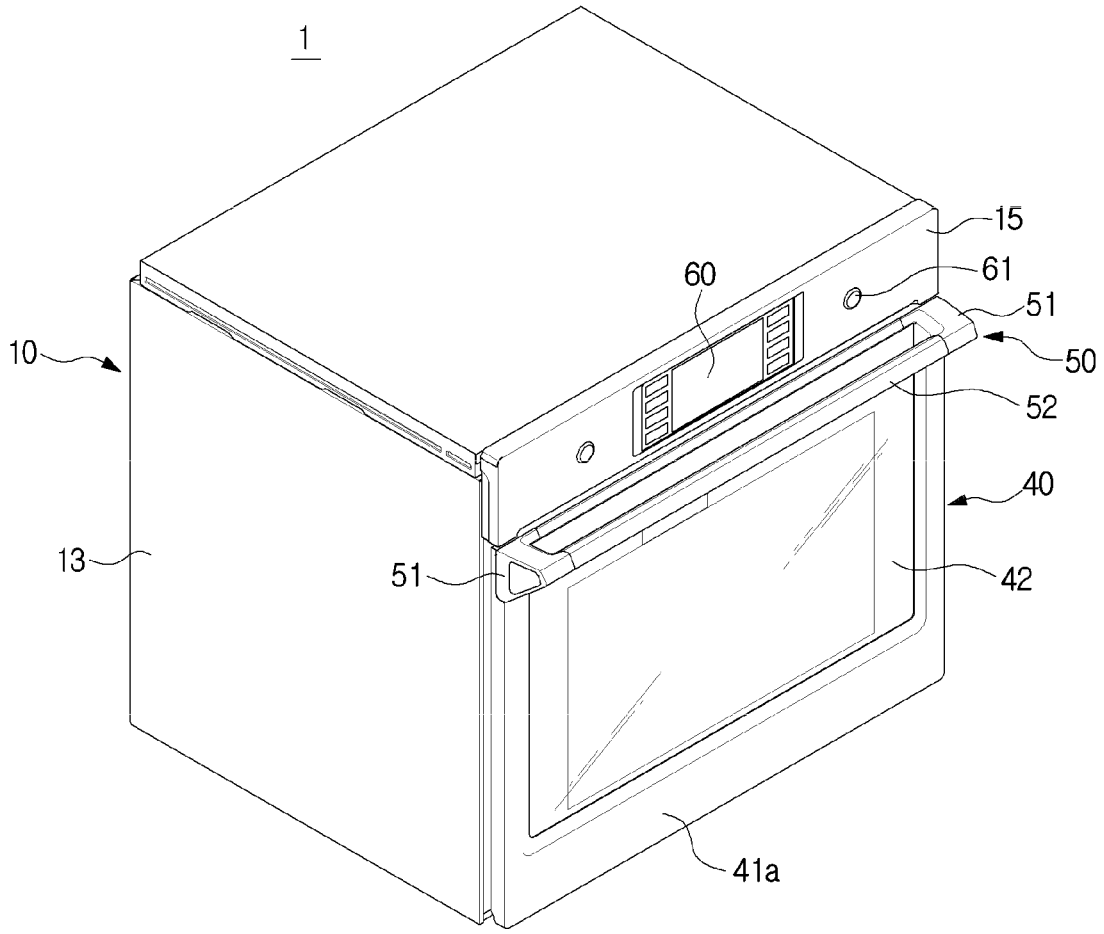
FIGS. 1 to 3 are views illustrating an example of a cooking apparatus in accordance with the disclosed embodiment.
Figure 2:
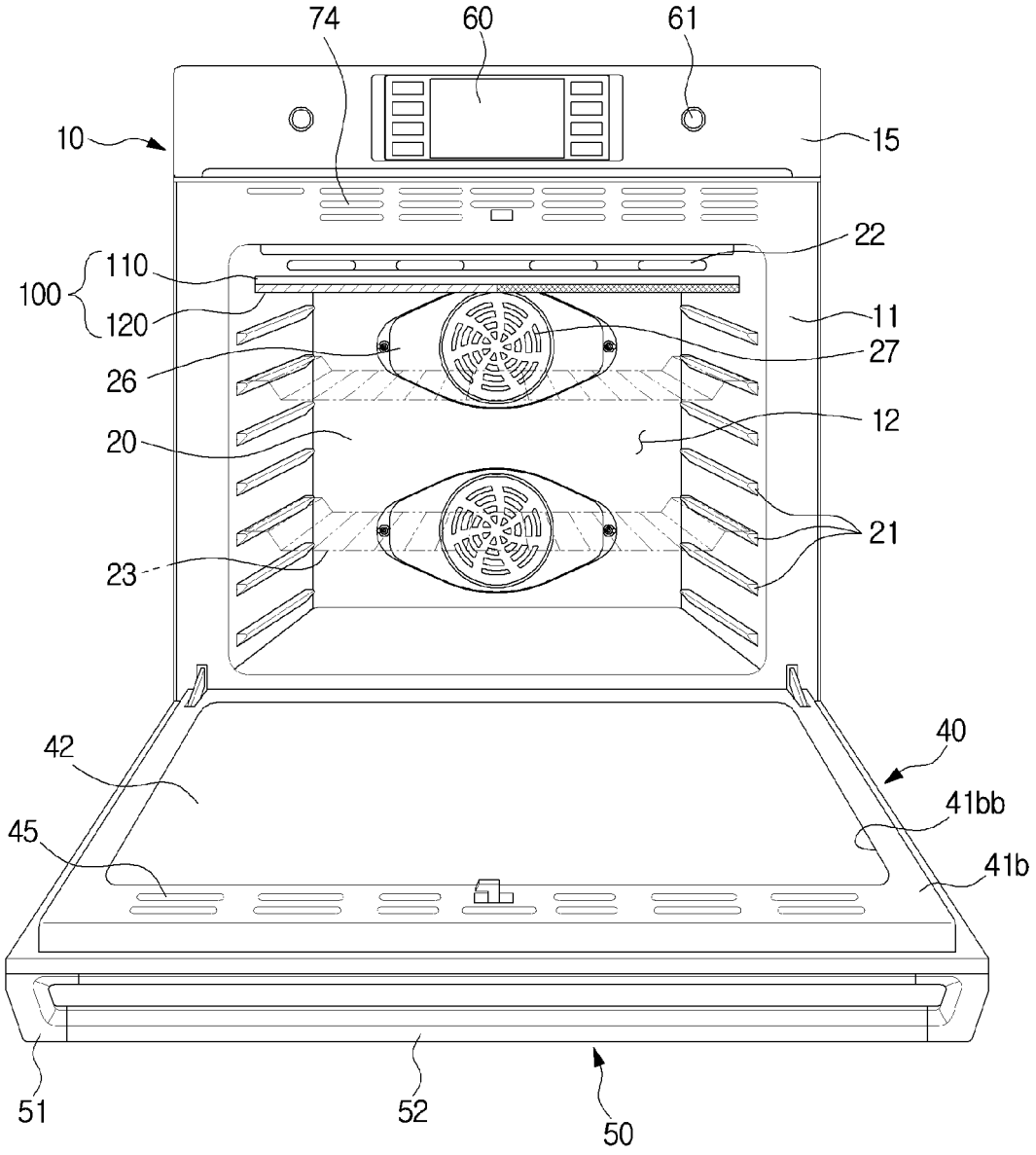
Figure 3:
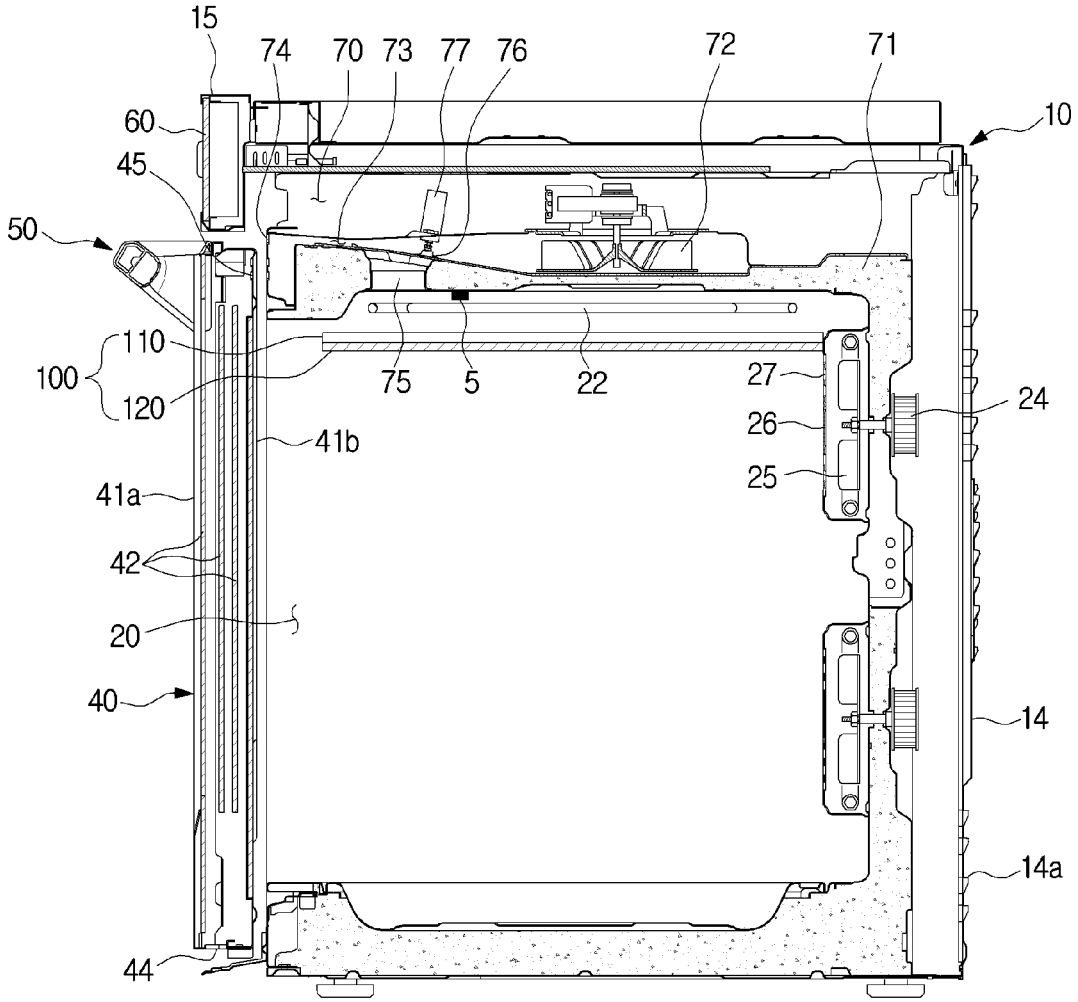
Figure 4:
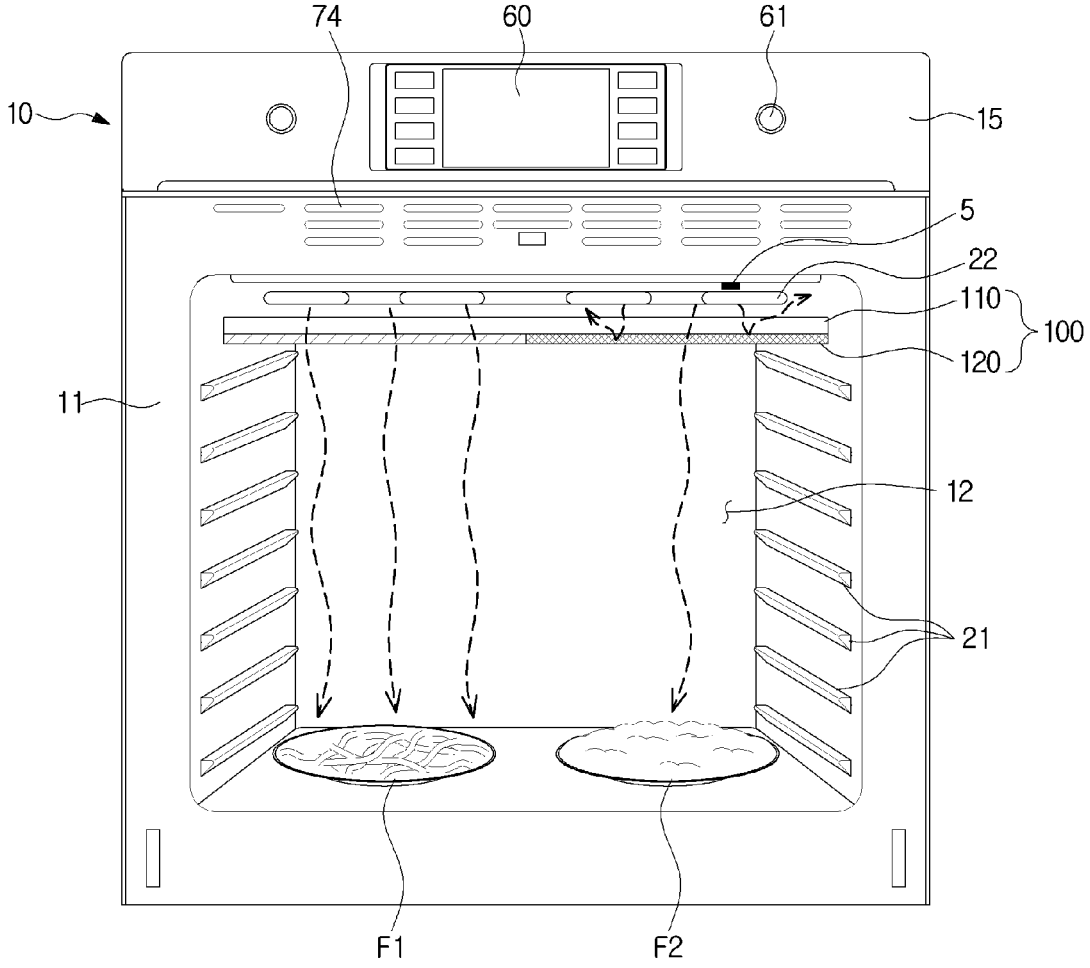
FIG. 4 is a view illustrating an example of a cooking apparatus having a reflection device in accordance with one embodiment of the present disclosure.
Figure 6:
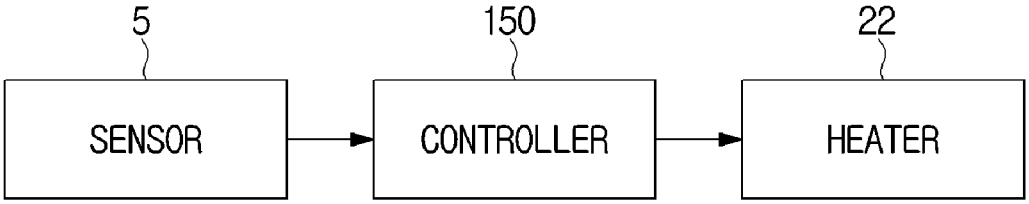
FIG. 6 is a view illustrating a configuration of the cooking apparatus in accordance with one embodiment of the present disclosure.
Figure 7:
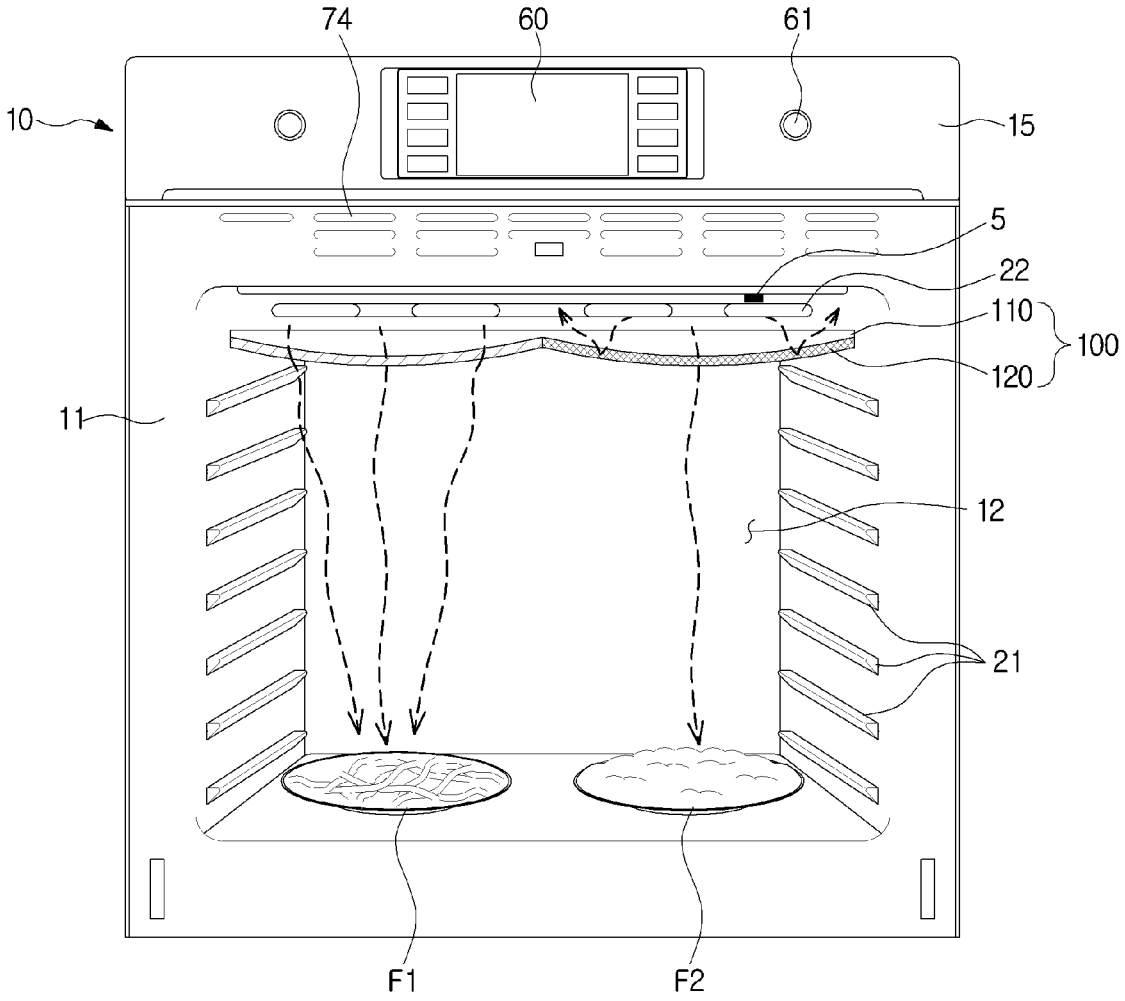
FIGS. 7 and 8 are views illustrating another example of a cooking apparatus having a reflection device in accordance with one embodiment of the present disclosure.
Figure 8:
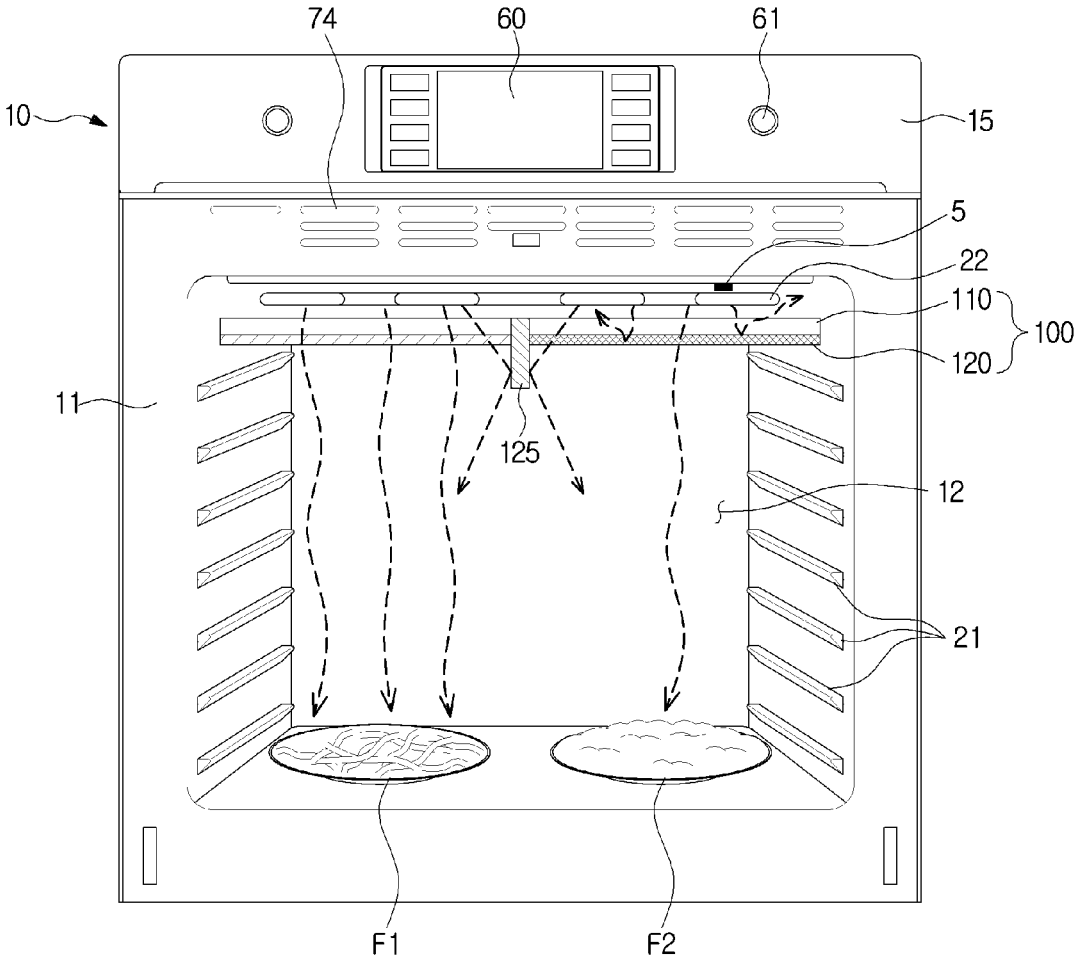
Figure 9:
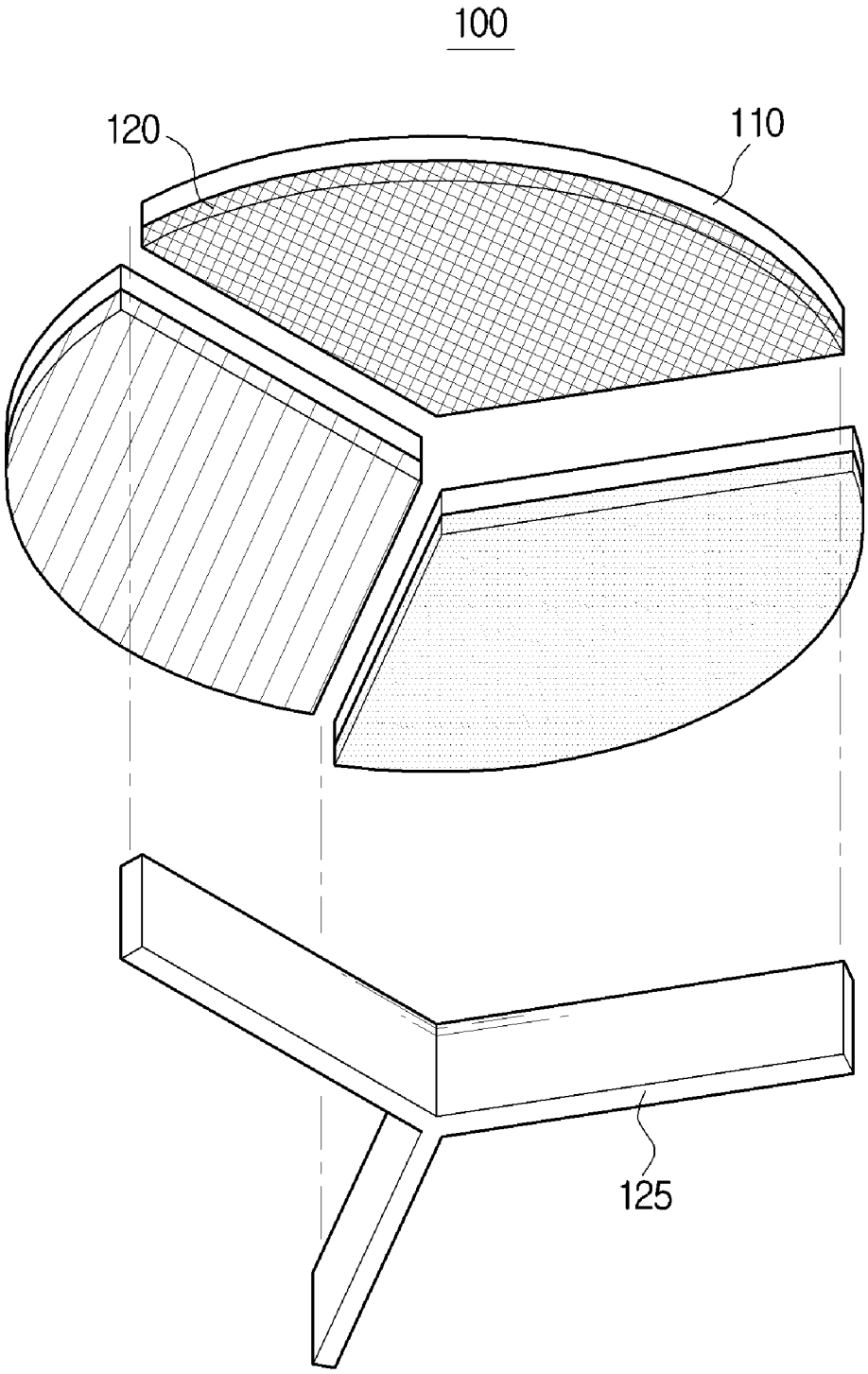
FIGS. 9 and 10A-10D are views illustrating a variety of examples of the reflection device in accordance with one embodiment of the present disclosure.

The present disclosure will be described more fully hereinafter with reference to the accompanying drawings. FIGS. 1 to 3 are views illustrating an example of a cooking apparatus in accordance with the disclosed embodiment, FIG. 4 is a view illustrating an example of a cooking apparatus having a reflection device in accordance with one embodiment of the present disclosure, and FIG. 5 is a view illustrating an example of a reflection device in accordance with one embodiment of the present disclosure. FIG. 6 is a view illustrating a configuration of the cooking apparatus in accordance with one embodiment of the present disclosure. FIGS. 7 and 8 are views illustrating another example of a cooking apparatus having a reflection device in accordance with one embodiment of the present disclosure, and FIGS. 9 and 10 are views illustrating a variety of examples of the reflection device in accordance with one embodiment of the present disclosure.

According to the disclosed embodiment, a cooking apparatus 1 is configured to perform cooking a food by heating a cooking material, and the cooking apparatus 1 may include an oven, a microwave, and a far-infrared cooking apparatus. Hereinafter for convenience of description, an oven will be described as an example of the cooking apparatus in accordance with the disclosed embodiment.

As illustrated in FIGS. 1 to 3, according to the disclosed embodiment, the cooking apparatus 1 may include a case 10 and a cooking compartment 20 provided inside of the case 10. The case 10 may include a front panel 11 forming a front surface of the case 10, a side panel 13 forming a side surface of the case 10 and a rear panel 14 forming a rear surface of the case 10.

The cooking compartment 20 having a box shape may be provided inside of the case 10 and a front surface thereof may be opened or closed by a door. The front panel 11 may include an opening 12 provided to correspond to the cooking compartment 20 having the front surface open. The cooking compartment 20 may include a plurality of supporters 21 protruding on a left and right side wall of the cooking compartment 20. A rack 23 in which a cooking material is placed may be mounted to the plurality of the supporters 21.

A heater 22 heating a cooking material may be provided in the cooking compartment 20. According to the disclosed embodiment, the heater 22 may include a heater configured to heat a cooking material by generating electromagnetic waves such as far-infrared rays. For example, according to the disclosed embodiment, the heater 22 may include an electric heater having an exothermic body. Hereinafter a heater configured to heat a cooking material by generating electromagnetic waves will be described as an example. A heat transfer regulator configured to control transferring heat generated by the heater to a cooking material may be provided in a lower side of the heater. The heat transfer regulator may control transferring heat generated by the heater to a cooking material by adjusting reflection, penetration and conduction of the heat. For example, as a heat transfer regulator, a reflection device 100 having a plurality of regions each having a different reflectance against electromagnetic waves generated by the heater 22 may be provided in the lower side of the heater 22. A detail description of the reflection device 100 will be described later. In addition, the cooking apparatus 1 may include a sensor 5 provided inside of the cooking compartment and configured to acquire information related to a cooking material. A detail description of the sensor 5 will be described later.

In a rear side of the cooking compartment 20, a convection fan 25 circulating air in the cooking compartment 20 to allow a cooking material to be evenly cooked and a convection motor 24 driving the convection fan 25 may be provided. A fan cover 26 covering the convection fan 25 may be provided in a front side of the convection fan 25, and a through hole 27 may be formed on the fan cover 26 to allow air to be moved therethrough.

The door may be hinge-coupled to a lower side of the case 10 so that the door is rotatable about the case 10. As another example, the door may be hinge-coupled to the left side or the right side of the case 10.

The door may include a transparent material, e.g. a glass 42 to allow a user to confirm a cooking process of a cooking material placed inside of the cooking compartment 20 from the outside, wherein a plurality of glasses may be included inside of the door. The door may include a front door frame 41*a* and a rear door frame 41*b* provided along an edge of the glass member. The door may include an air inlet 44 disposed on a lower end portion thereof to allow air to be introduced from the outside to the inside of the door. An external air introduced via the lower end portion of the door may exchange heat with heated air that is delivered from the cooking compartment 20 while moving to an upper side in the inside of the door, and then discharged to an air outlet 45 provided in the rear door frame 41*b*. Using the above mentioned configuration, the heat inside of the door may be cooled through the air circulation according to the present disclosure.

The door may include a handle 50 provided in an upper end portion of the front surface of the door so that a user holds the door to open and close the door. When the door is hinge-coupled to the left side or the right side of the case 10, the handle 50 may be provided in the right side or the left side of the door to correspond to the location of the door. The handle 50 may be protruded toward the front side with a predetermined length from the front surface of the door 40. That is, the handle 50 may include a pair of handle supporters 51 extending from the front surface of the door 40 to the front side and a handle extension 52 connecting the pair of handle supporters 51.

The cooking apparatus 1 may include a display 60 disposed on an upper portion of the front surface of the front panel 11 to display a variety of information related to an operation of the cooking apparatus 1 and to allow a user to input an operation command. The display 60 may be provided in an electronic component room cover 15. The display 60 may employ Light Emitting Diode (LED), Organic Light Emitting Diode (OLED) or Liquid Crystal Display (LCD). In addition, the display 60 may employ Touch Screen Panel (TSP) configured to receive an input of a control command from a user and to display operation information corresponding to the control command received. The touch screen panel may include a display to display the operation information and a control command inputtable by a user, a touch panel to detect coordinates with which a user's body part is in contact and a touch screen controller to determine the control command input by the user based on the contact coordinates detected by the touch panel.

The touch screen controller may recognize the control command input by the user by comparing a user's touch coordinate detected by the touch panel with a coordinate of the control command displayed through the display.

The cooking apparatus 1 may include an operator 61 provided in the electronic component room cover 15 to allow an additional command for an operation of the cooking apparatus 1 to be input.

The cooking apparatus 1 may include an electronic components room 70 in which an electronic component configured to control an operation of a variety of components including a display module 60 is accommodated. The electronic components room 70 may be provided in an upper side of the cooking compartment 20. An insulation member 71 may be provided between the electronic components room 70 and the cooking compartment 20 to insulate between the electronic components room 70 and the cooking compartment 20 so that hot air in the cooking compartment 20 is prevented from being delivered to the electronic components room 70.

As well as the insulation member 71 is provided between the electronic components room 70 and the cooking compartment 20, the insulation member 71 may be configured to cover an entire of the outside of the cooking compartment 20 so that hot air in the cooking compartment 20 is prevented from being delivered to the outside of the cooking apparatus 1.

The cooking apparatus 1 may include a cooling structure to cool the electronic components room 70 by circulating air in the surrounding of the cooking compartment 20. The cooling structure of the cooking apparatus 1 may include a cooling fan unit 72 moving air, and a cooling flow path 73 discharging air introduced by the cooling fan unit 72 to the front side.

The external air may be introduced to the electronic components room 70 via a through hole 14*a* formed in the rear panel 14, and the air introduced to the electronic components room 70 may be moved to the inside of the electronic components room 70 to cool the electronic component and then discharged to the front side of the cooking apparatus 1 along the cooling flow path 73 through a discharge port 74.

A part of air in the cooking compartment 20 may be introduced to a side of the cooling flow path 73 through a discharge flow path 75 and then discharged to the front side of the cooking apparatus 1. In addition, a bypass hole 76 introducing a part of air that moves to the discharge port 74 to the discharge flow path 75 may be additionally provided. The bypass hole 76 may be opened or closed by a switching device 77, and an amount of air of the cooking compartment 20 that is discharged to the discharge flow path 75 may be adjusted depending on opening or closing of the bypass hole 76.

According to the disclosed embodiment, the cooking apparatus 1 may include a reflection device 100 having a plurality of regions each having a different reflectance so that cooking materials which are needed to be cooked at a different cooking temperature and for a different cooking time, or with a cooking recipe are cooked at one time, as illustrated in FIG. 4.

That is, as illustrated in FIG. 4, when the cooking apparatus 1 uses a single heater 22, it may be difficult for the cooking apparatus 1 to provide a cooking temperature and time of a first cooking material (F1) and a second cooking material (F2) requiring a different cooking temperature and time. Therefore, it may be difficult for the cooking apparatus 1 to cook a plurality of cooking materials each having a different cooking temperature and time to be cooked at one time.

In order to cook a plurality of cooking materials each having a different cooking temperature and time at one time, the cooking apparatus 1 may be required to cook each cooking material at a proper cooking temperature and for a proper cooking time. According to the disclosed embodiment, the cooking apparatus 1 may include a reflection device 100 having a plurality of regions each having a different reflectance to cook cooking materials at a proper cooking temperature and for a proper cooking time, as illustrated in FIG. 4.

The reflection device 100 may be provided in a lower side of the heater 22 so that electromagnetic waves generated by the heater 22 are incident to the reflection device 100. The reflection device 100 may be implemented by a shape and an area configured to cover an entire shape and area of the heater 22 and then provided in the lower side of the heater 22. Hereinafter the reflection device 100 having a circular shape will be described as an example. The reflection device 100 may be fixedly installed on a left and right wall or an upper surface of the inside of the cooking compartment 20. Alternatively, the reflection device 100 may be installed to be rotatable or to allow a translational movement, but the installation of the reflection device 100 is not limited thereto. The reflection device 100 may be installed in various methods.

The reflection device 100 of the cooking apparatus 1 shown in FIG. 4 may be implemented by a coated glass. That is, the reflection device 100 may include a glass 110 and a coating layer 120 formed in a plurality of regions of the reflection device 100 and having a variety of reflectance against the electromagnetic waves.

Figure 5A:
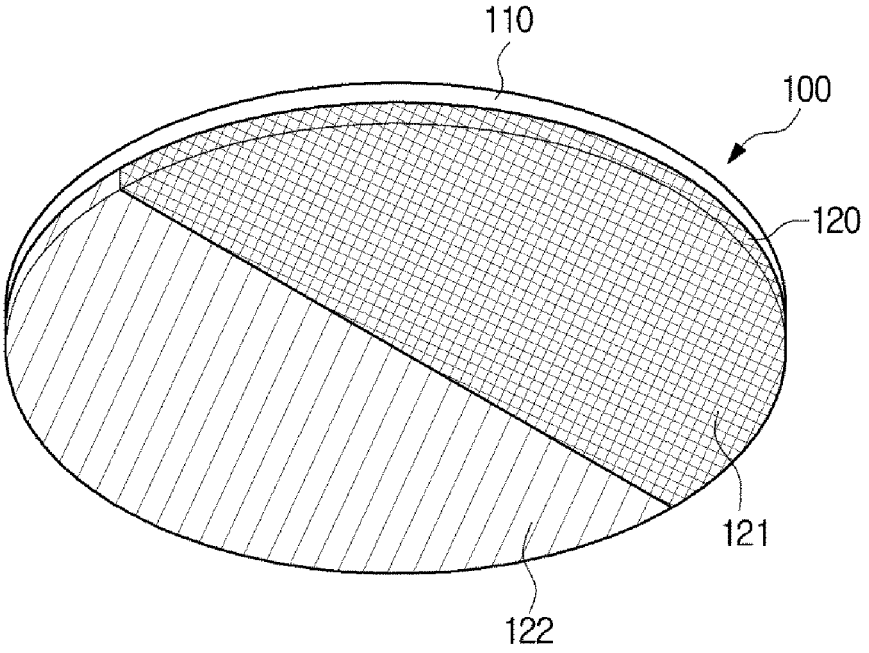
FIGS. 5A-5B are views illustrating an example of a reflection device in accordance with one embodiment of the present disclosure.
Figure 5B:
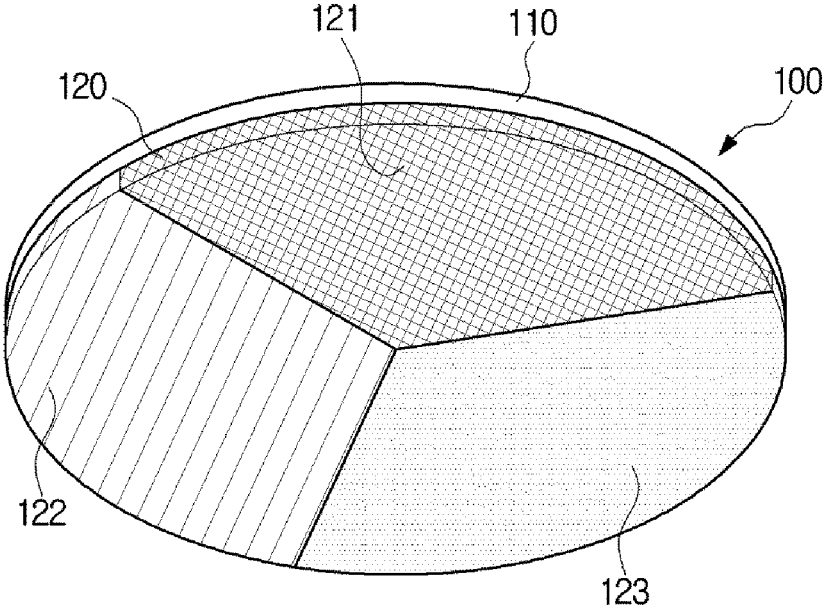

FIG. 5 is a perspective view of the reflection device 100 schematically illustrating the coating layer 120 provided on a lower surface of the reflection device 100. FIG. 5 illustrates the reflection device 100 having a circular shape, but the shape of the reflection device 100 is not limited thereto. Therefore, the reflection device 100 may be implemented by a shape and an area configured to cover an entire shape and area of the heater 22, as mentioned above. In addition, FIGS. 5A and 5B illustrate that the reflection device 100 has two regions 121 and 122 each having a different reflectance and three regions 121, 122 and 123 each having a different reflectance, but the number of the region is not limited thereto. Therefore, the number of the region may be four or more.

The reflection device 100 may be provided such that a coating layer 120 having a different reflectance is formed in each of a plurality of regions in a piece of glass 110, or the coating layer 120 having a different reflectance is formed in a plurality of glasses 110 corresponding to each of a plurality of regions and then the plurality of glasses 110 is assembled.

Alternatively, the reflection device 100 may be provided such that the coating layer 120 having a different reflectance is formed in the glass 110 having the same reflectance and the same thickness, as mentioned above, so that the plurality of regions has a different reflectance against the electromagnetic waves generated by the heater 22. In addition, the reflection device 100 may include a plurality of regions each having a different reflectance such that the coating layer 120 each having a different reflectance is formed in a plurality of glasses 110 in which at least one of the reflectance and the thickness thereof is different from each other. That is, according to the disclosed embodiment, the reflection device 100 may be implemented by adjusting the thickness or the reflectance of the glass 110 and the reflectance of the coating layer 120 so that the plurality of regions of the reflection device 100 has a different reflectance.

The glass 110 may be implemented by a color glass in which pigments are mixed and thus the reflectance of the glass 110 may be adjusted to be various.

The coating layer 120 may be formed on the glass 110 with a thickness of approximately 2~5 nm using Chemical Vapor Deposition (CVD) method or Physical Vapor Deposition (PVD) method, and then formed on the glass 110 with a thickness of approximately 10~50 um using dipping method or spray coating method.

The coating layer 120 may be formed of a material such as an oxide, e.g, SnO2, Ag, STS or Ti to have a certain reflectance against the infrared in the electromagnetic waves. In addition, the coating layer 120 may be formed of a silver nitrate to have a certain reflectance against ultraviolet and visible light as well as the infrared. The coating layer 120 may be formed on at least one of a lower surface or an upper surface of the reflection device 100.

As mentioned above, the reflectance of the coating layer 120 may be determined by a coating material or a thickness of the coating layer 120. That is, the reflectance of the plurality of regions of the reflection device 100 may be determined by the thickness or the reflectance of the glass 110 and the material or the thickness of the coating layer 120.

Data may be stored in advance, wherein the data may include a cooking time or a cooking temperature that is required to properly cook a variety of cooking materials cooked by using the cooking apparatus 1 according to the disclosed embodiment. The reflectance of the plurality of regions of the reflection device 100 may be determined based on the data so that a different cooking material is cooked at a proper cooking temperature, and in order to achieve the determined reflectance, the reflection device 100 may be implemented by adjusting the thickness or the reflectance of the glass 110 and the material or the thickness of the coating layer 120.

Referring to FIG. 4, according to the disclosed embodiment, despite of using the cooking apparatus 1 having a single heater 22, the cooking apparatus 1 in which the above mentioned reflection device 100 is installed may cook two cooking materials, which are different from each other, at one time.

FIG. 4 illustrates an example of cooking the first cooking material (F1) and the second cooking material (F2) which requires a different cooking temperature from each other. The reflection device 100 shown in FIG. 4 may be implemented to allow a reflectance of a first region 122 to be higher than a reflectance of a second region in the plurality of regions. Therefore, an intensity of the electromagnetic waves passing through the first region 122 may be higher than an intensity of the electromagnetic waves passing through the second region and thus a cooking material, to which the electromagnetic waves passing through the first region 122 is incident, is cooked at a higher cooking temperature than that of a cooking material to which the electromagnetic waves passing through the second region is incident. In a state in which a cooking temperature of the first cooking material (F1) in the plurality of the cooking materials, is higher than a cooking temperature of the second cooking material (F2), when the first cooking material (F1) is placed on a bottom or a region of a cooking ware corresponding to the first region 122 and the second cooking material (F2) is placed on a bottom or a region of a cooking ware corresponding to the second region, the first cooking material (F1) and the second cooking material (F2) may be cooked at a different temperature, that is, the first cooking material (F1) may be cooked at a higher cooking temperature than a cooking temperature of the second cooking material (F2).

Referring to FIG. 6, the cooking apparatus 1 may include a sensor 5 configured to acquire information related to a cooking material, a heater 22 configured to generate heat, and a controller 150 configured to control driving of the heater 22 based on the information acquired by the sensor 5.

According to the disclosed embodiment, the cooking apparatus 1 may include the sensor 5 configured to identify a cooking material and to detect a cooking state of the cooking material. The sensor 5 may be provided inside of the cooking compartment 20, and the sensor 5 may include an infrared sensor detecting a temperature of the cooking material, a camera acquiring an image of the cooking material and a gas sensor detecting a gas generated in the cooking material.

The controller 150 of the cooking apparatus 1 may identify the cooking material based on the information of the cooking material detected by the sensor 5 and determine a cooking temperature and time required for cooking the identified cooking material. The controller 150 may determine the cooking temperature and time required for cooking the identified cooking material by matching cooking data including a predetermined cooking temperature and time according to a cooking material, with the identified cooking material. The controller 150 may pre-store cooking data including a cooking temperature and time which are appropriate to cook a variety of cooking materials. In addition, the cooking apparatus 1 may store the above mentioned data in a memory by including an additional memory. A memory 115 may include a volatile memory, e.g. S-RAM and D-RAM and a nonvolatile memory e.g. a flash memory, a Read Only Memory, an Erasable Programmable Read Only Memory (EPROM), and an Electrically Erasable Programmable Read Only Memory (EEPROM).

Particularly, the nonvolatile memory may semi-permanently store a control program and control data to control an operation of the cooking apparatus 1. The volatile memory may call the control program and control data from the nonvolatile memory and memory the control program and control data or the volatile memory may memory a user command received via the display or the operator or a variety of control signal output from the controller 150.

The controller 150 may determine an operation time and an output of the heater 22 based on the reflectance of each region of the reflection device 100 and the cooking temperature and time of the identified cooking material, and drive the heater 22 based on the determined operation time and output.

For example, the controller 150 may determine a cooking time and drive the heater 22 for the determined time so that cooking of the plurality of cooking materials is completed at the same time. The controller 150 may determine a cooking time that is the longest in a cooking time of the plurality cooking material, as an operation time of the heater 22. As for the cooking material requiring a shorter cooking time than the determined operation time of the heater 22, since a cooking time thereof is increased, the corresponding cooking material may be required to be cooked at a lower cooking temperature than a predetermined cooking temperature. As mentioned above, the controller 150 may adjust a cooking temperature of the plurality of the cooking material according to the determined operation time of the heater 22, and determine an output of the heater 22 by considering the reflectance of the plurality of regions of the reflection device 100 so that the cooking material is cooked at the adjusted cooking temperature. The controller 150 may control the operation of the heater 22 based on the determined operation time and output of the heater 22.

During cooking the cooking material, when a cooking state of the cooking material is detected by the sensor 5, the controller 150 may appropriately adjust an operation of the heater 22 for the cooking state based on the change in the cooking state of the cooking material. For example, when it is determined that the cooking material is quickly cooked, based on an image of the cooking material acquired by the camera, the controller 150 may reduce the output of the heater 22 or the operation time of the heater 22.

FIGS. 7 and 8 illustrate another example of the reflection device 100 in accordance with the disclosed embodiment.

Referring to FIG. 7, the glass 110 forming the plurality of regions of the reflection device 100 may be formed in a convex shape that is recessed toward a lower side. In the convex surface of the reflection device 100, the above mentioned coating layer 120 may be coated in the plurality of regions with a different reflectance. The reflection device 100 may be formed such that convex lens having a shape corresponding to the plurality of regions of the reflection device 100 are assembled to each other.

When a lower portion of the reflection device 100 has a convex shape, as illustrated in FIG. 7, the electromagnetic waves passing through each region may be focused on a cooking material placed on a bottom of the cooking compartment corresponding to the corresponding region. When the electromagnetic waves passing through each region move toward electromagnetic waves passing through another adjacent region, the interference between electromagnetic waves passing through different regions may occur. When the interference between electromagnetic waves passing through different regions occurs, heat that is greater or less than heat generated by the electromagnetic waves passing through each region may be transmitted to the cooking material and thus it may be difficult to properly cook the plurality of the cooking material. According to the disclosed embodiment, since a lower surface of each region of the plurality of regions of the reflection device 100 has a convex shape, as illustrated in FIG. 7, the above mentioned difficulties may be relieved.

The convex portion of the plurality of regions of the reflection device 100 may have a predetermined curvature so that the electromagnetic waves, which is generated by the heater 22 and then incident to the reflection device 100, are moved in a space corresponding to the corresponding region as illustrated in FIG. 7, while preventing from being moved toward the electromagnetic waves passing through another regions. In addition, the curvature of the convex portion of the reflection device 100 may be determined in consideration of the size of the inside of the cooking compartment 20 so that the electromagnetic waves passing through the reflection device 100 are not focused on a certain region of the cooking material.

FIG. 8 illustrates another example of the reflection device to prevent the interference between electromagnetic waves passing through the plurality of regions of the reflection device 100.

Referring to FIG. 8, a lower surface of the reflection device 100 may be provided in a flat shape in contrast to the reflection device 100 shown in FIG. 7. The reflection device 100 shown in FIG. 8 may include a reflector 125 provided in a boundary between the plurality of regions to prevent the interference between the electromagnetic waves passing through the plurality of regions. As illustrated in FIG. 8, among the electromagnetic waves passing through the plurality of regions, electromagnetic waves moving toward electromagnetic waves passing through another adjacent region may be reflected by the reflector 125 so that the interference with the electromagnetic waves passing through adjacent region does not occur.

The reflector 125 provided on the boundary of the plurality of regions may be implemented by a material determined through experiments so that the reflector 125 has a reflectance that is appropriate for the reflection of the electromagnetic wave. In addition, the reflector 125 may be protruded from the lower surface of the reflection device 100 with a predetermined length to prevent the interference of the electromagnetic wave passing through the each region of the reflection device 100.

FIG. 9 is an exploded-perspective view of the reflection device 100 of FIG. 8. As illustrated in FIG. 9, the reflection device 100 may include the plurality of glasses 110 corresponding to the plurality of regions and the reflector 125 having a predetermined thickness and having a shape corresponding to the boundary between the plurality of glasses 110. As mentioned above, the coating layer 120 having a different reflectance may be provided on the lower surface of the plurality of glasses 110. In addition, the thickness of the reflector 125 may be thicker than the glass 110 and the reflector 125 may be protruded to the lower surface of the reflection device 100, as illustrated in FIG. 7.

Furthermore, the reflector 125 may also perform the function of preventing thermal conductivity between the plurality of regions. The reflector 125 may be provided on the boundary between the glasses 110 forming the plurality of regions to prevent a connection between the glasses 110 so that the thermal conductivity between the plurality of regions is prevented. Therefore, the reflector 125 may be selected by considering the thermal conductivity as well as the reflectance.

Figure 10A:
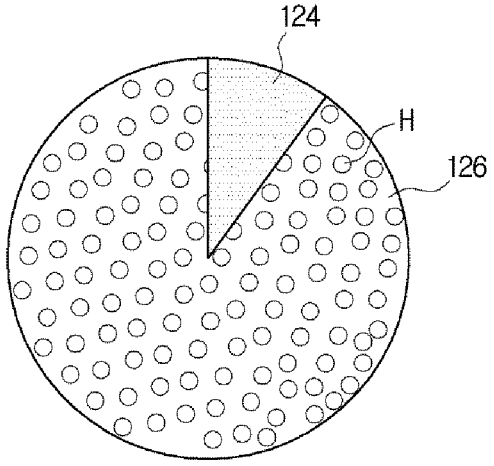
Figure 10B:
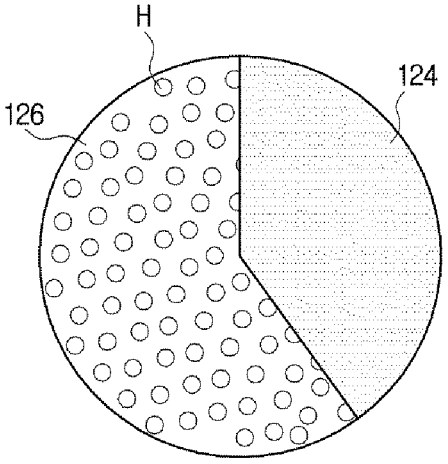
Figure 10C:
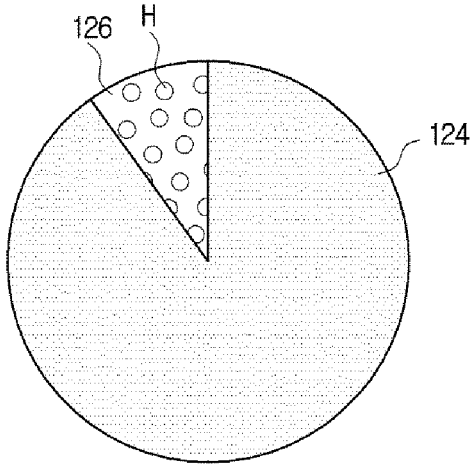
Figure 10D:
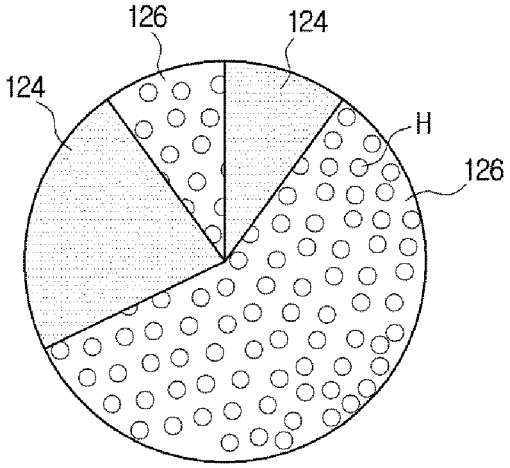

FIGS. 10A-10D are views of another example of the reflection device 100. The above mentioned reflection device 100 may adjust the intensity of the electromagnetic wave passing through the reflection device 100 by including the glass 110 and the coating layer 120, but alternatively, the reflection device 100 shown in FIGS. 10A-10D may include a first region 124 shielding the electromagnetic wave incident to the reflection device 100, and a second region 126 in which a large number of hole (H) is provided to allow the electromagnetic wave to pass through. The size of the first region 124 and the second region 126 of the reflection device 100 may be adjustable, as illustrated in FIGS. 10A-10D. That is, as illustrated in FIGS. 10A to 100, when the area of the first region 124 is increased, the area of the second region 126 may be reduced as much as the increased area of the first region 124, and in contrast, when the area of the second region 126 is increased, the area of the first region 124 may be reduced as much as the increased area of the second region 126. In addition, as illustrated in FIG. 10 D, the first region 124 and the second region 126 may include at least two regions, respectively.

As for the reflection device 100 show in FIGS. 10A-10D, the second region 126 may be provided to cover the shape or the area of the heater 22, and the first region 124 may be configured to be spread or closed like as a fan, on a lower surface or an upper surface of the second region 126 so that the first region 124 is configured to adjust the area of the second region 126. The above mentioned structure is an example, and thus the reflection device 100 may be implemented using a variety of structures configured to adjust the area of the first region 124 and the second region 126.

The first region 124 and the second region 126 of the reflector device 100 shown in FIGS. 10A-10D may be implemented by galvanized iron, iron, aluminum or copper, and the second region 126 may be formed such that a number of holes are formed in the above-mentioned materials. In addition, as for the reflection device 100, the reflectance, absorption, or radiation rate of the heat generated by the heater 22 may be adjusted by a coating process on the above-mentioned materials.

The reflection device 100 formed of glass, shown in FIGS. 4, 7 and 8, and the reflection device 100 shown in FIGS. 10A-10D may be used alone, or the reflection device 100 according to any one example of FIGS. 4, 7 and 8, and the reflection device 100 shown in FIGS. 10A-10D may be used together with each other so that the plurality of cooking materials is cooked at a proper cooking temperature at one time.

Figure 11:
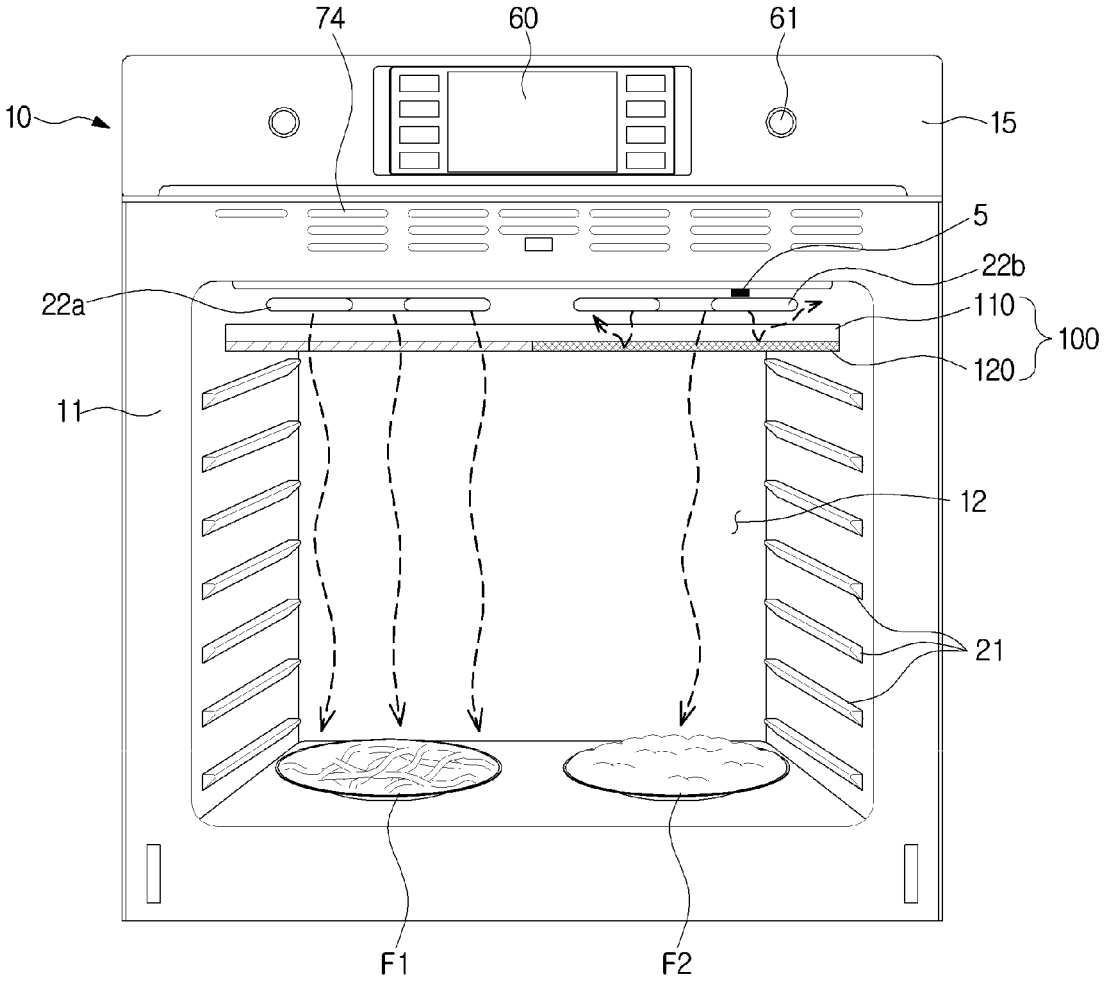
FIG. 11 is a view illustrating an example of a reflection device and a cooking apparatus having a plurality of heaters in accordance with one embodiment.
Figure 12:
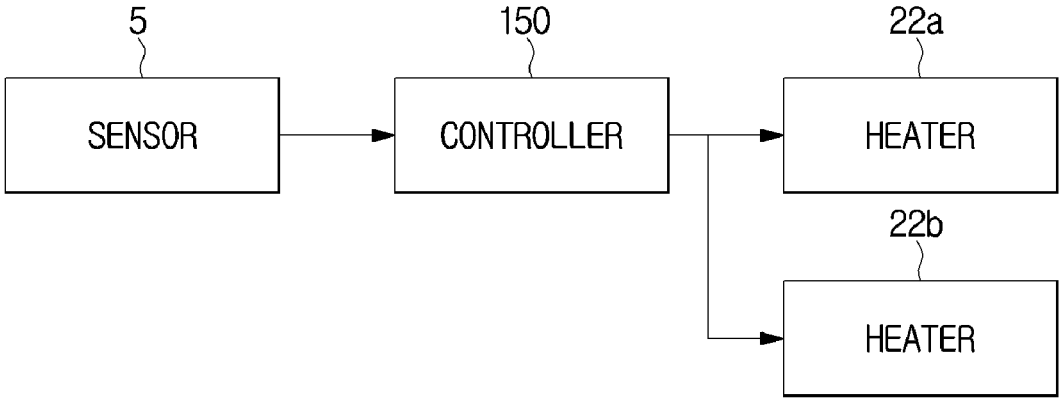
FIG. 12 is a control diagram of the cooking apparatus according to one embodiment.
Figure 13:
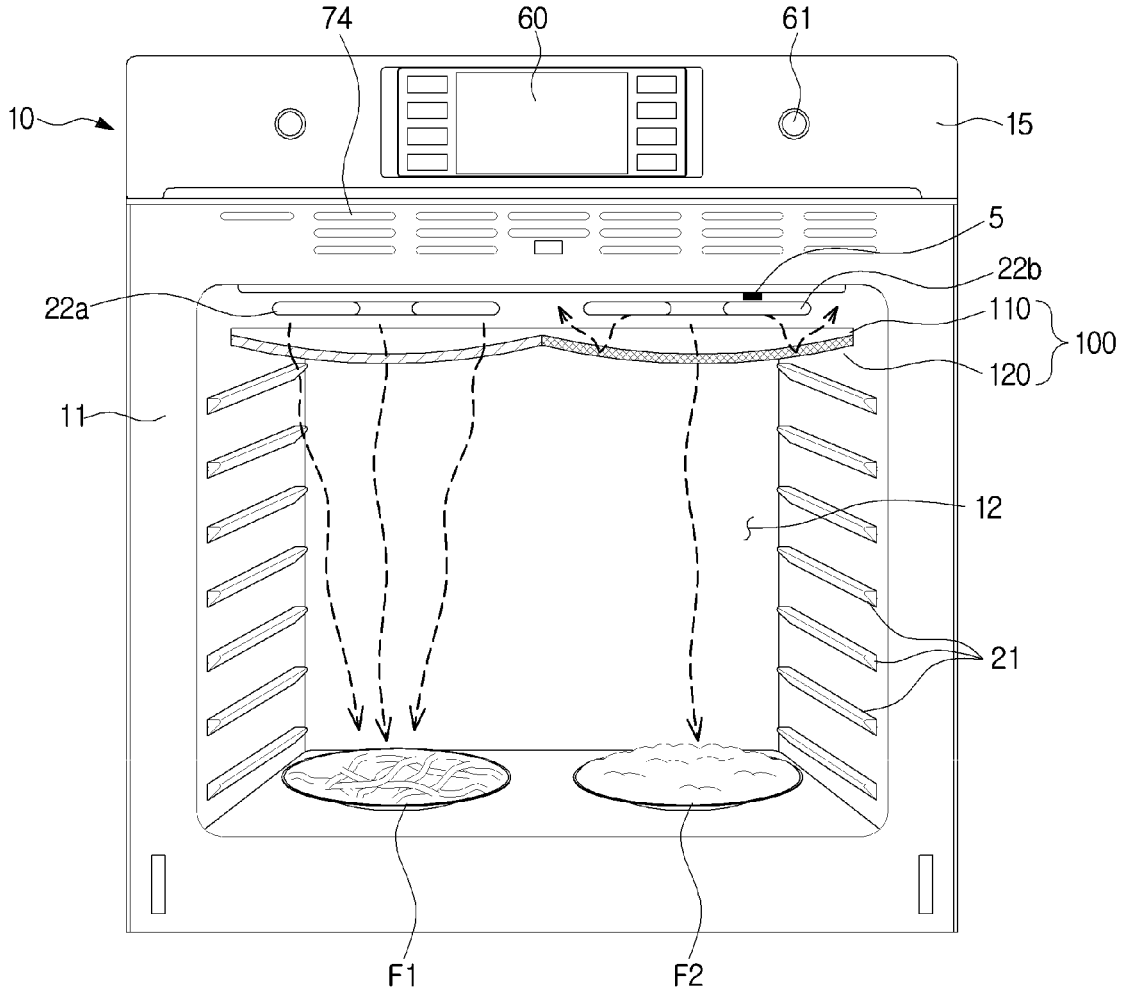
FIGS. 13 to 15 are views illustrating another example of the reflection device and the cooking apparatus having the plurality of heaters in accordance with one embodiment.
Figure 14:
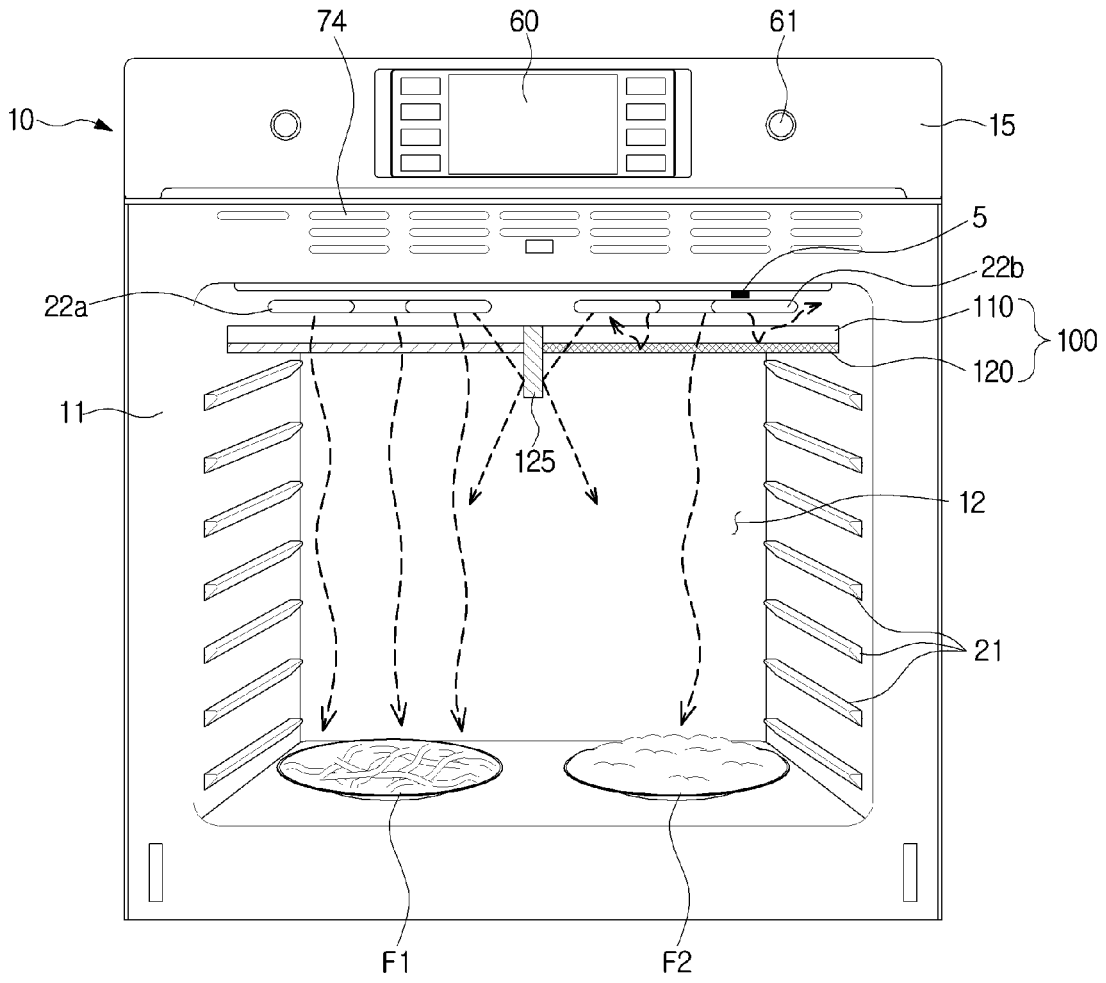
Figure 15:
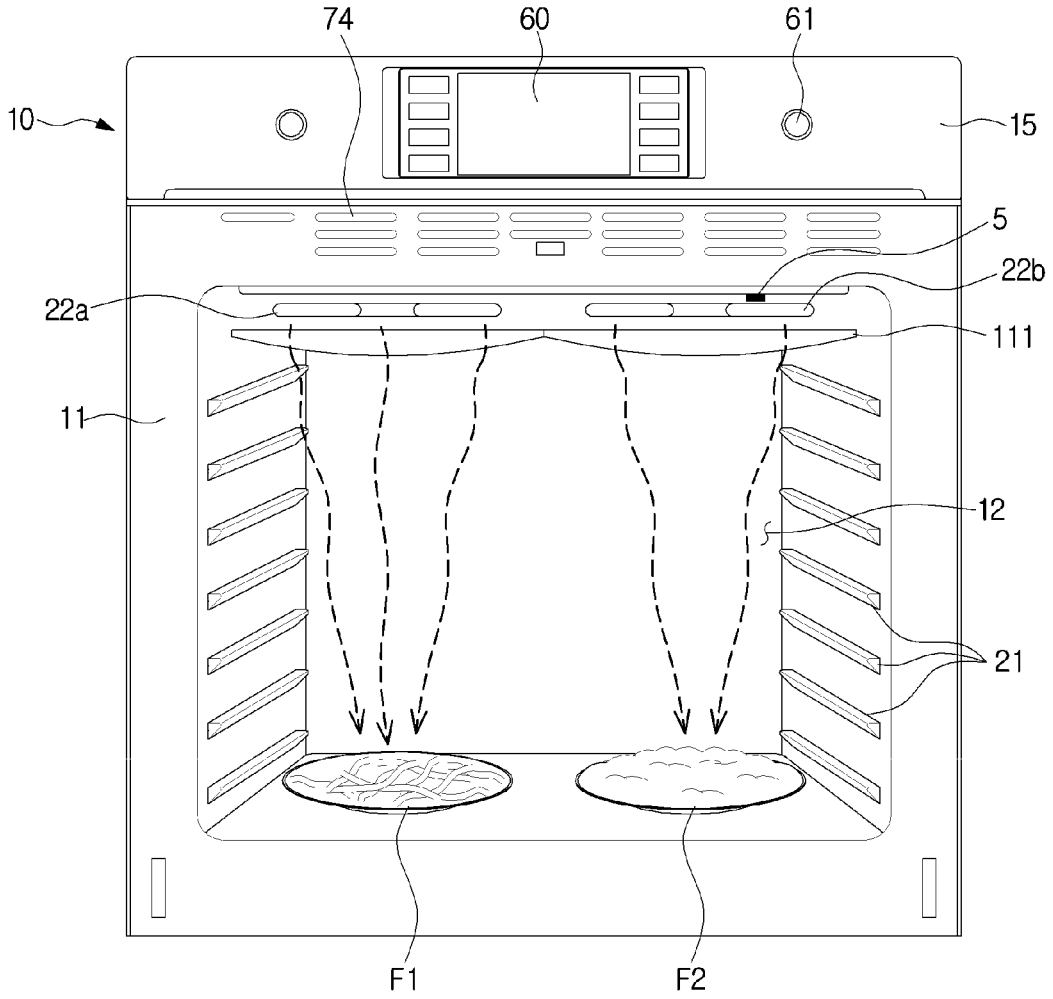

Meanwhile, the plurality of cooking materials is cooked by a single heater 22 as illustrated in the above mentioned cooking apparatus 1 or by a plurality of heaters 22*a* and 22*b* of cooking apparatus 1 according to one embodiment described later. FIG. 11 is a view illustrating an example of a reflection device 100 and a cooking apparatus 1 having a plurality of heaters 22*a* and 22*b* in accordance with one embodiment, FIG. 12 is a control diagram of the cooking apparatus 1 according to one embodiment. FIGS. 13 to 15 are views illustrating another example of the reflection device 100 and the cooking apparatus 1 having the plurality of heaters 22*a* and 22*b* in accordance with one embodiment.

In comparison with the cooking apparatus 1 having a single heater, the cooking apparatus 1 having a plurality of heaters may cook the plurality of cooking materials at one time by adjusting a temperature of each heater for a proper cooking temperature of the plurality of cooking materials. Firstly, an embodiment shown in FIG. 11 will be described.

The cooking apparatus 1 shown in FIG. 11 may have the same structure of the cooking apparatus 1 shown in FIG. 4 except that the cooking apparatus 1 shown in FIG. 11 has the plurality of heaters. The number of the plurality of regions of the reflection device 100 each having a different reflectance may correspond to the number of the heater 22. That is, when two heaters are provided, two regions of the reflection device 100 may be provided. A case in which the number of the region of the reflection device 100 is the same as the number of the heater is an example, and thus the number of the region of the reflection device 100 is larger than the number of the heater. A description of the reflection device 100 is the same as the description of FIG. 4 and thus it will be omitted.

When the plurality of heaters 22*a* and 22*b* are used, the heater may be of the same type or different types. For example, a heater configured to generate electromagnetic waves including wavebands, e.g. infrared, ultraviolet, and visible light, and a heater configured to generate micro waves may be used, but is not limited thereto. A heater in a various types may be used.

As for the cooking apparatus 1 shown in FIG. 11, an output of the plurality of heaters 22*a* and 22*b* may be differently adjusted and the reflectance of the plurality of regions of the reflection device 100 may be different from each other. Therefore, the cooking apparatus 1 shown in FIG. 11 may precisely adjust a cooking temperature by adjusting an output of the plurality of heaters 22*a* and 22*b* for the plurality of cooking materials based on the reflectance of the region of the reflection device 100 corresponding to the plurality of heaters 22*a* and 22*b*.

The first region 122 corresponding to the first heater 22*a* among the plurality of regions of the reflection device 100 may include a plurality of regions. Also, the second region corresponding to the second heater 22*b* among the plurality of regions of the reflection device 100 may include a plurality of regions. That is, the first region 122 may include the plurality of regions each having a different reflectance, and the second region may include the plurality of regions each having a different reflectance. In this case, the cooking apparatus 1 having the plurality of heaters may cook the larger number of cooking material than the number of cooking material cooked by the cooking apparatus 1 having a single heater, at one time.

Referring to FIG. 12, the cooking apparatus 1 may include a sensor 5 acquiring information related to a cooking material, a plurality of heaters 22*a* and 22*b* generating heat, and a controller 150 driving the plurality of heaters 22*a* and 22*b* based on the information acquired by the sensor 5.

A description of the sensor 5 is the same as the sensor of FIG. 6, and thus it will be omitted. The controller 150 of the cooking apparatus 1 may identify a cooking material based on the information acquired by the sensor 5, and determine a cooking temperature and time required for the identified cooking material. The controller 150 may determine the cooking temperature and time required for cooking the identified cooking material by matching cooking data including a predetermined cooking temperature and time according to a cooking material, with the identified cooking material. The controller 150 may pre-store cooking data including a cooking temperature and time which are appropriate to cook a variety of cooking materials. In addition, the cooking apparatus 1 may store the above mentioned data in a memory by including an additional memory.

The controller 150 may determine an expected operation time and output of the plurality of heaters 22*a* and 22*b* based on the cooking temperature and time of the identified cooking materials, and drive the heaters based on the determined expected operation time and output.

For example, the controller 150 may determine the cooking temperature and time of the cooking materials and drive the plurality of heaters 22*a* and 22*b* for the determined cooking time so that cooking of the cooking materials is completed at the same time. That is, when a first cooking time is required to cook the first cooking material (F1), the controller 150 may determine an expected cooking time of the first heater 22*a* as the first cooking time, and when a second cooking time is required to cook the second cooking material (F2), the controller 150 may determine an expected cooking time of the second heater 22*b* as the second cooking time. When the first cooking time is required to cook the first cooking material (F1), the controller 150 may determine an output (a first output) of the first heater 22*a* based on the first cooking time, and when the second cooking time is required to cook the second cooking material (F2), the controller 150 may determine an output (a second output) of the second heater 22*b* based on the second cooking time.

The controller 150 may determine the longest expected operation time between the expected operation time of the plurality of heaters 22*a* and 22*b* as an expected operation time of the plurality of heaters 22*a* and 22*b*. For example, when the expected operation time of the first heater 22*a* is longer than that of the second heater 22*b*, the controller 150 may determine the expected operation time of the first heater 22*a* as an expected operation time of the first heater 22*a* and the second heater 22*b*. As for the second heater 22*b* requiring the shorter expected operation time than the determined operation time, since an operation time thereof is increased, it may be appropriate that the second cooking material (F2) cooked by the second heater 22*b* is cooked at a lower cooking temperature than a predetermined second cooking temperature. Therefore, the controller 150 may control an operation of the second heater 22*b* so that the output of the second heater 22*b* is reduced than the second output. In addition, the controller 150 may adjust an output of the second heater 22*b* by considering the reflectance of the region of the reflection device 100 corresponding to the second heater 22*b*.

The controller 150 may determine the shortest expected operation time between the expected operation time of the plurality of heaters 22*a* and 22*b* as an expected operation time of the plurality of heaters 22*a* and 22*b*. For example, when the expected operation time of the second heater 22*b* is shorter than that of the first heater 22*a*, the controller 150 may determine the expected operation time of the second heater 22*b* as an expected operation time of the first heater 22*a* and the second heater 22*b*. As for the first heater 22*a* requiring the longer expected operation time than the determined operation time, since an operation time thereof is reduced, it may be appropriate that the first cooking material (F1) cooked by the first heater 22*a* is cooked at a higher cooking temperature than a predetermined first cooking temperature. Therefore, the controller 150 may control an operation of the first heater 22*a* so that the output of the first heater 22*a* is increased than the first output. In addition, the controller 150 may adjust an output of the first heater 22*a* by considering the reflectance of the region of the reflection device 100 corresponding to the first heater 22*a*.

The controller 150 may determine an output of the plurality of heaters 22*a* and 22*b* by considering the determined operation time of the heater and the reflectance of the plurality of regions of the reflection device 100, and control the operation of the plurality of heaters 22*a* and 22*b* based on the determined output and operation time of the heater.

During cooking the cooking material, when a cooking state of the cooking material is detected by the sensor 5, the controller 150 may appropriately adjust the operation of the heater for the cooking state according to a change in the cooking state of the cooking material. For example, when it is determined that the cooking material is quickly cooked, based on an image of the cooking material displayed on an image acquired by the camera, the controller 150 may reduce the output or the operation time of the heater.

FIGS. 13 to 15 are views illustrating another example of the reflection device 100 in accordance with the disclosed embodiment.

The cooking apparatus 1 according to the embodiment shown in FIG. 13 may be the same as the cooking apparatus 1 according to the embodiment shown in FIG. 7, except that the cooking apparatus 1 of FIG. 13 has a plurality of heaters, and thus a description of the reflection device 100 of FIG. 13 will be replaced by the description of the reflection device 100 of FIG. 7.

Also, the cooking apparatus 1 according to the embodiment shown in FIG. 14 may be the same as the cooking apparatus 1 according to the embodiment shown in FIG. 8, except that the cooking apparatus 1 of FIG. 14 has a plurality of heaters, and thus a description of the reflection device 100 of FIG. 14 will be replaced by the description of the reflection device 100 of FIG. 8.

Referring to FIG. 15, the reflection device 100 may include an optical lens 111 in which a lower surface is a convex shape, wherein the number of the optical lens 111 corresponds to the number of the heater. Although, the embodiment shown in FIG. 15 is similar with the embodiment shown in FIG. 13, the reflection device 100 of FIG. 15 excludes the coating layer 120. The cooking apparatus 1 shown in FIG. 15 may include a plurality of heaters 22*a* and 22*b* so that a cooking temperature of the plurality of cooking materials is achieved by controlling the plurality of heaters 22*a* and 22*b*. Therefore, the reflection device 100 may exclude the plurality of regions each having a different reflectance by including the coating layer 120, but include a plurality of optical lens 111 to focus electromagnetic waves generated by the plurality of heaters 22*a* and 22*b* to the cooking material. The reflection device 100 may be installed such that the plurality of optical lens 111 separated from each other is provided on a lower side of each of the plurality of heaters 22*a* and 22*b*, respectively or the reflection device 100 may be installed as a single reflection device 100 in which the plurality of optical lens is assembled with each other is provided on a lower side of the heater.

Figure 16:
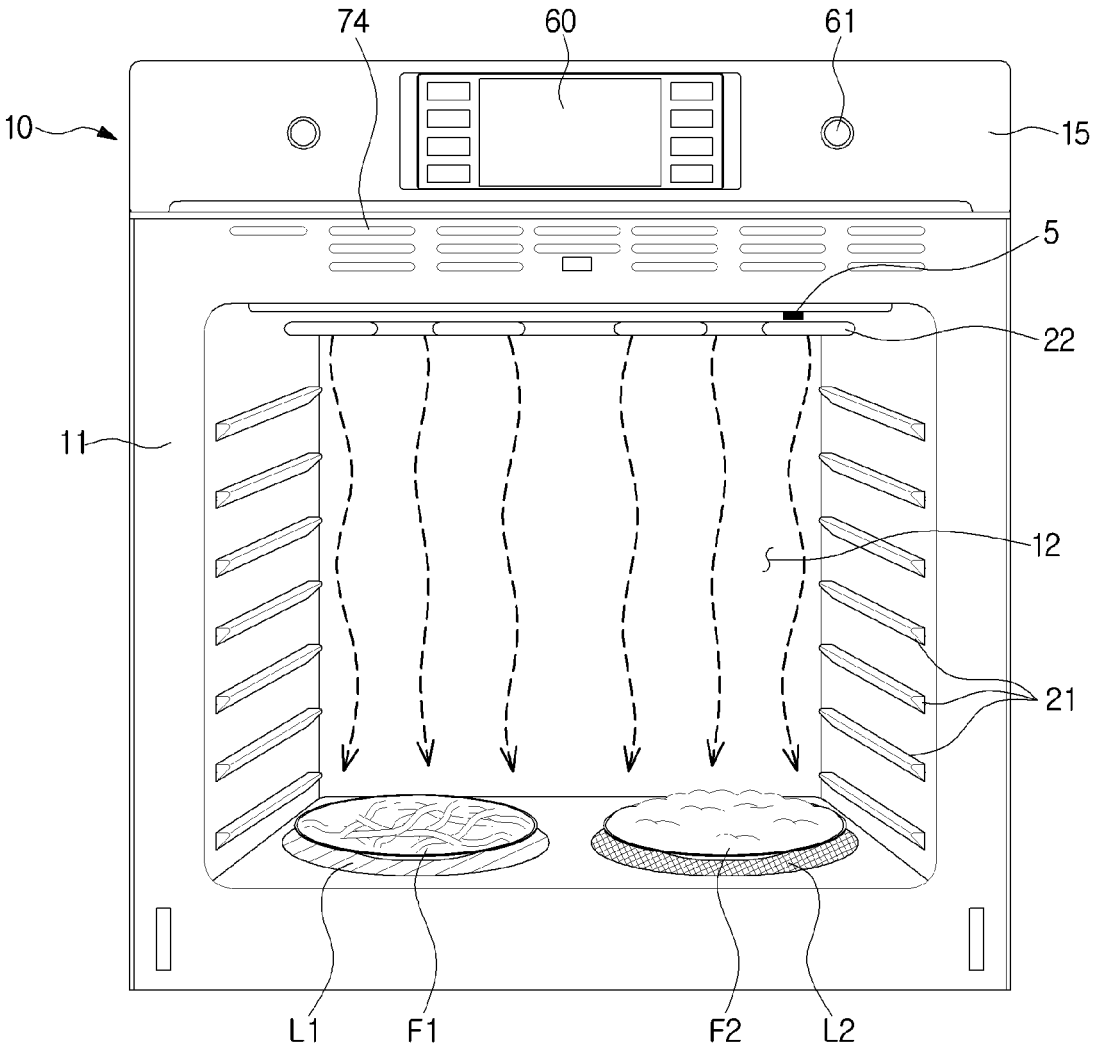
FIGS. 16 and 17 are views illustrating an example of a bottom surface of the cooking apparatus in accordance with the disclosed embodiment.
Figure 17:
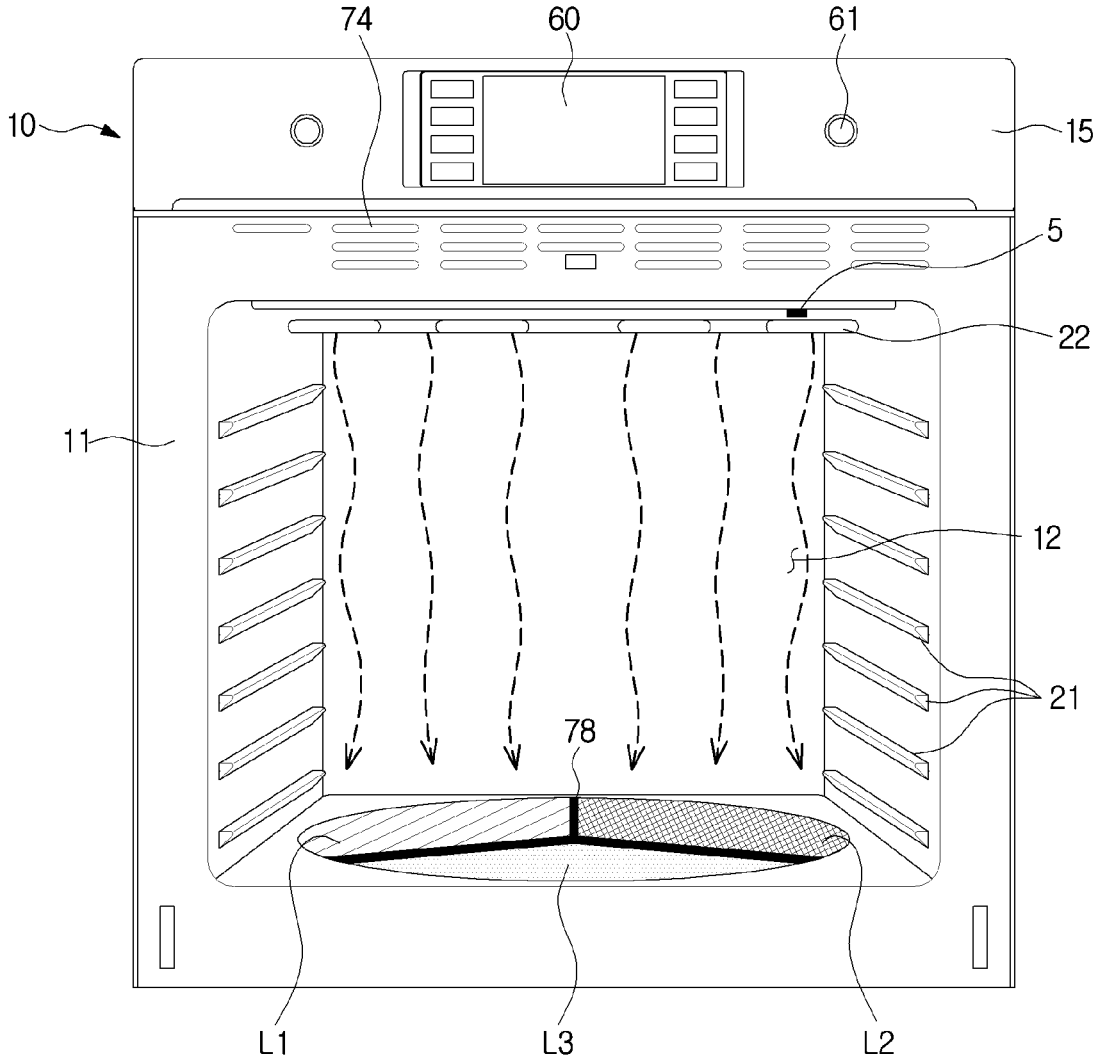
Figure 18:
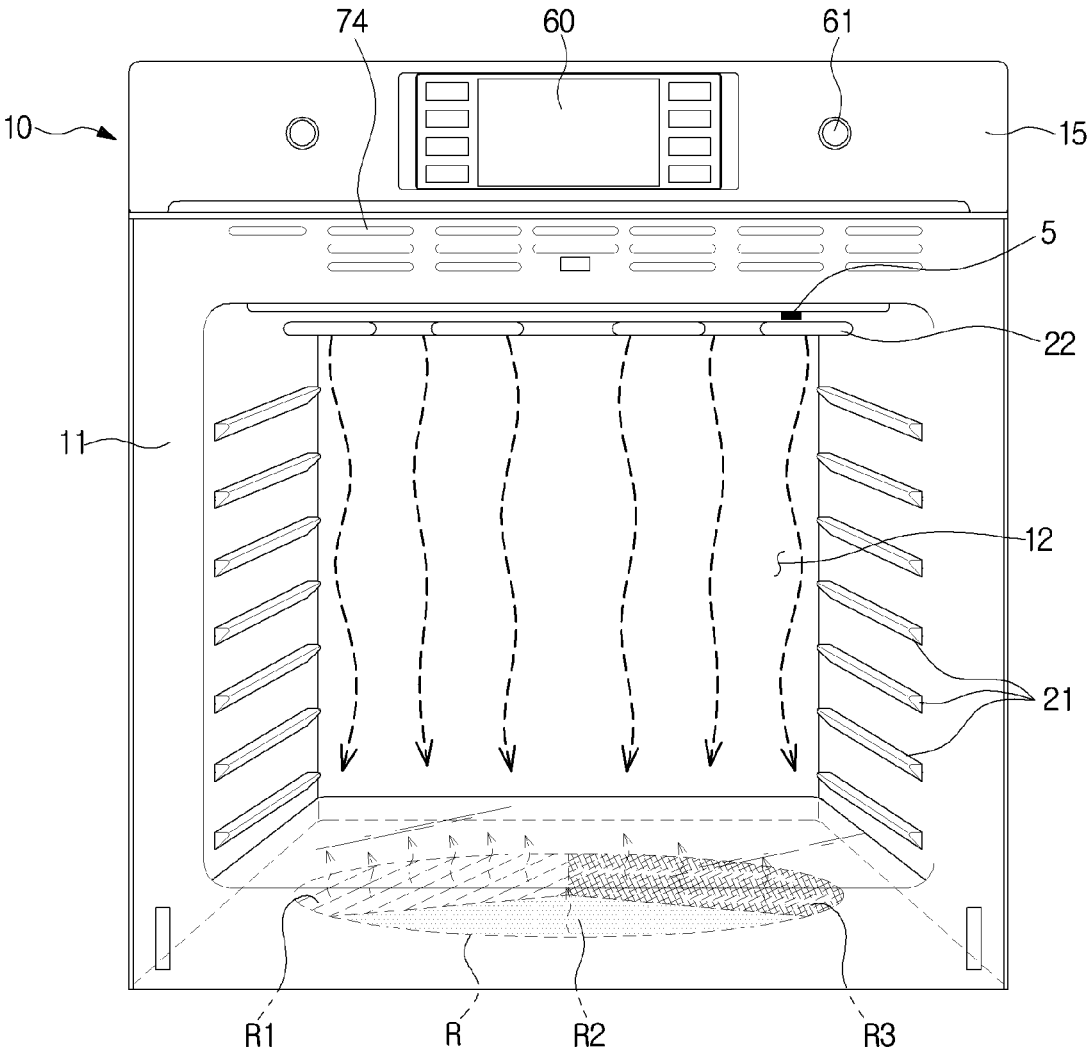
FIG. 18 is a view illustrating an example of a lower reflection device provided on a lower side of the bottom surface of the cooking apparatus in accordance with the disclosed embodiment.

The cooking apparatus 1 according to the disclosed embodiment may include a plurality of regions each having a different heat absorption rate on a bottom surface of the cooking compartment in which a cooking material is placed. FIGS. 16 and 17 are views illustrating an example of a bottom surface of the cooking apparatus 1 in accordance with the disclosed embodiment, and FIG. 18 is a view illustrating an example of a lower reflection device (R) provided on a lower side of the bottom surface of the cooking apparatus 1 in accordance with the disclosed embodiment.

As illustrated in FIG. 16, in the bottom surface of the cooking apparatus 1, a plurality of regions may be provided to allow a plurality of cooking materials requiring a different cooking temperature to be placed thereon. The plurality of regions provided on the bottom surface may be provided to have a different heat absorption rate from each other. For example, in the plurality of regions, a first region (L1) may be provided to have a higher heat absorption rate than that of a second region (L2). The plurality of regions may be implemented by respective materials having different respective specific heat or respective phase change materials. For example, each of the plurality of regions may be implemented by any one material selected from substances such as tetradecane, octadecane or nonadecane. The selected material may have different densities in the respective areas so that the heat absorption rate of the plurality of regions is different from each other. The heat absorption rate may vary by changing the ratio of the above mentioned selected material included in plurality of regions. Alternatively, it may be achieved that the heat absorption rate in each region differs from each other through a combination of the materials. The material forming the plurality of regions of the bottom surface of the cooking apparatus 1 is not limited thereto, and thus the plurality of regions of the bottom surface of the cooking apparatus 1 may be implemented by a variety of materials.

The number of the plurality of regions of the bottom surface may correspond to the number of the plurality of regions of the reflection device 100, and when the heater 22 of the cooking apparatus 1 is provided in plural, the number of the plurality of regions of the bottom surface may correspond to the number of the heater 22. Embodiments relating to the plurality of regions of the bottom surface shown in FIG. 16 may be combined with the above mentioned various embodiments of the cooking apparatus 1. That is, embodiments relating to the plurality of regions of the bottom surface shown in FIG. 16 may be included in the cooking apparatus 1 including a single heater 22 and the reflection device 100 according to the embodiment and the cooking apparatus 1 including a plurality of heaters 22*a* and 22*b* and the reflection device 100 according to the embodiment.

A region having a high heat absorption rate among the plurality of regions of the bottom surface may correspond to a region of the reflection device 100 having a low reflectance, or correspond to the heater, which is controlled to have a high output, among the plurality of heaters 22*a* and 22*b*. A region having a low heat absorption rate among the plurality of regions of the bottom surface may correspond to a region of the reflection device 100 having a high reflectance, or correspond to the heater, which is controlled to have a low output, among the plurality of heaters 22*a* and 22*b*.

As illustrated in FIGS. 16 and 17, the plurality of regions (L1, L2 and L3) of the bottom surface may be apart from each other with a predetermined interval to prevent thermal conductivity among the plurality of regions. Alternatively, as illustrated in FIG. 17, the plurality of regions of the bottom surface may include a material 78 in a space between the regions to prevent the thermal conductivity among the plurality of regions, wherein the material 78 has a lower thermal conductivity than a reference value and includes materials such as teflon, ceramic, aerogel.

FIG. 18 is a view illustrating a lower reflection device (R) provided in a lower side of the bottom surface of the cooking compartment of the cooking apparatus 1. The lower reflection device (R) may reflect a heat, which is absorbed in the bottom surface and then radiated to a lower side of the bottom surface, to the bottom surface again, so that the thermal efficiency is improved.

For example, a first region (R1) of the lower reflectance device (R) having a high heat reflectance may be provided on a lower side of a region, having a high heat absorption rate, of the plurality of regions of the bottom surface, so as to reflect a heat, which is radiant from the bottom surface, to the bottom surface again. A second region (R2) of the lower reflectance device (R) having a lower heat reflectance than that of the first region may be provided on a lower side of a region, having a low heat absorption rate, of the plurality of regions of the bottom surface, so as to less reflect heat, which is radiant from the bottom surface, than the first region. A third region (R3) of the lower reflectance device (R) having a lower heat reflectance than that of the second region may be provided on a lower side of a region, having a low heat absorption rate, of the plurality of regions of the bottom surface, so as to less reflect heat, which is radiant from the bottom surface, than the second region. The first region having the high heat reflectance may be provided in a white color, and the third region having the low heat reflectance may be provided in a black color. The heat reflectance of the lower reflection device (R) may be adjusted by a color, as mentioned above, but is not limited thereto. Therefore, it may be adjusted in various ways.

Embodiments relating to the lower reflection device (R) shown in FIG. 18 may be combined with the above mentioned various embodiments of the cooking apparatus 1. That is, embodiments relating to the lower reflection device (R) shown in FIG. 18 may be included in the cooking apparatus 1 according to the embodiment including a single heater 22 and the reflection device 100, and the cooking apparatus 1 according to the embodiment including a plurality of heaters 22*a* and 22*b* and the reflection device 100.

Figure 19:
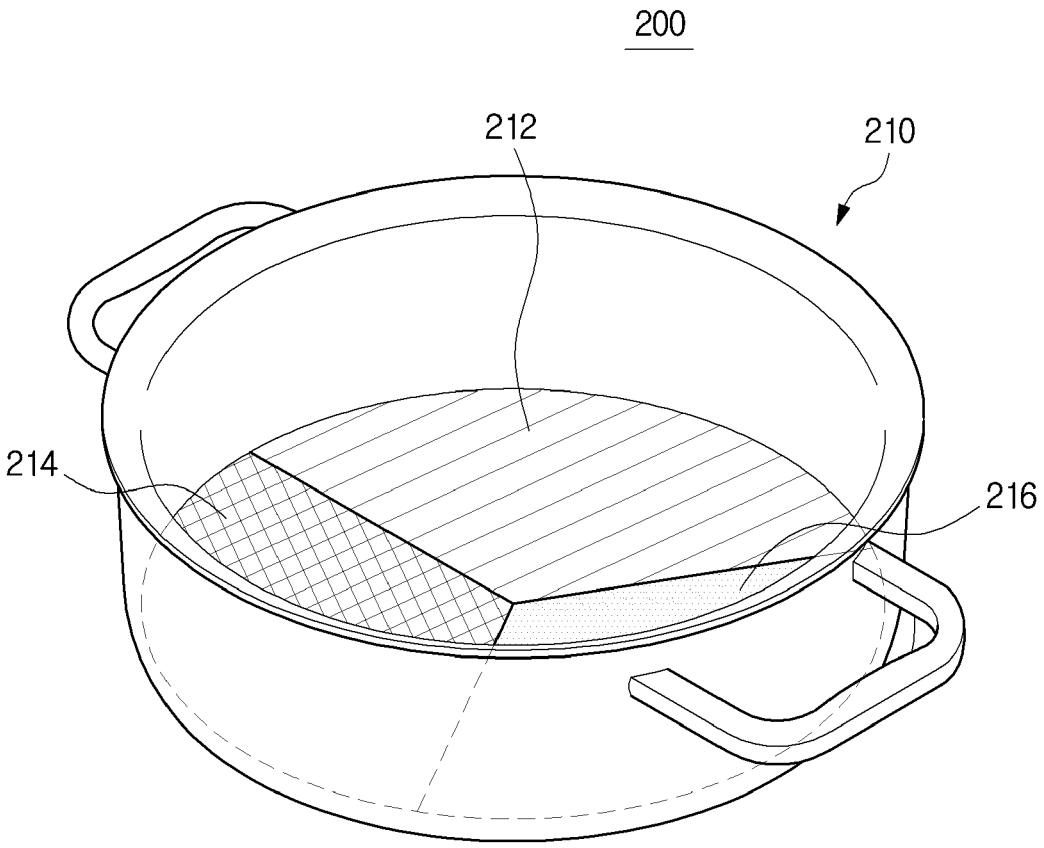
FIGS. 19, 20 and 21A-21D are views illustrating a cooking ware in accordance with the disclosed embodiment.
Figure 20:
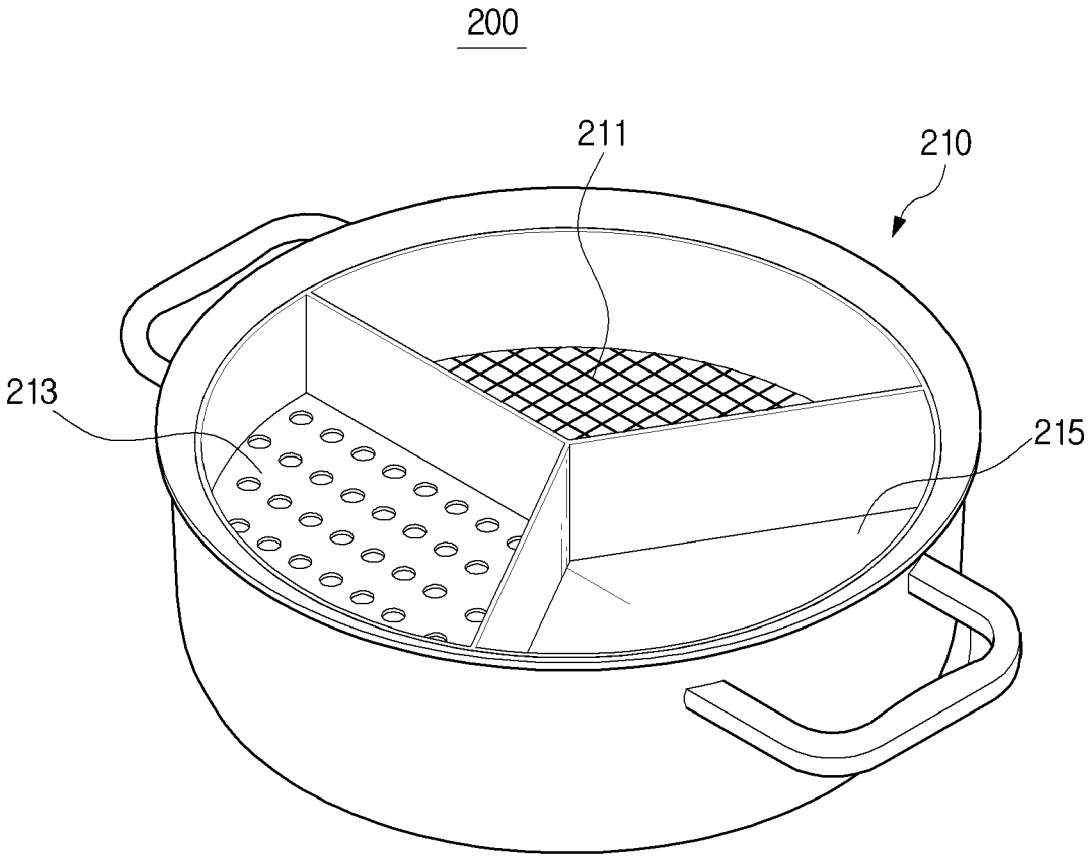

As illustrated in FIG. 17, the plurality of regions each having a different heat absorption rate may be provided on the bottom surface of the cooking compartment of the cooking apparatus 1, and a plurality of regions each having a different heat absorption rate may be provided on a bottom surface of a cooking ware 200. FIGS. 19 to 21 are views illustrating a cooking ware 200 in accordance with the disclosed embodiment.

Referring to FIG. 19, according to the disclosed embodiment, a body 210 of the cooking ware 200 may include a plurality of regions 212, 214, and 216 each having a different heat absorption rate, on a bottom surface in which a cooking material is placed. For example, among the plurality of regions, a first region 212 may have a higher heat absorption rate than that of a second region 214, and the second region 214 may have a higher heat absorption rate than that of a third region 216. The plurality of regions may be implemented by respective materials having different respective specific heat or respective phase change materials. For example, each of the plurality of regions may be implemented with any one material selected from substances such as tetradecane, octadecane or nonadecane. The selected material may have different densities in the respective areas so that the heat absorption rate of the plurality of regions is different from each other. The heat absorption rate may vary by changing the ratio of the above mentioned selected material included in plurality of regions. Alternatively, it may be achieved that the heat absorption rate in each region differs from each other through a combination of the materials. The material forming the plurality of regions of the bottom surface of the cooking ware 200 is not limited thereto, and thus the plurality of regions of the bottom surface of the cooking ware 200 may be implemented by a variety of materials.

According to the disclosed embodiment, the number of the plurality of regions of the bottom surface of the cooking ware 200 may correspond to the number of the plurality of regions of the reflection device 100 included in the cooking apparatus 1, and when the heater of the cooking apparatus 1 is provided in plural, the number of the plurality of regions of the bottom surface of the cooking ware 200 may correspond to the number of the heater.

Among the plurality of regions of the bottom surface of the cooking ware 200, a region having a high heat absorption rate may be placed inside of the cooking compartment to correspond to a region of the reflection device 100 having a low reflectance, or correspond to the heater, which is controlled to have a high output, among the plurality of heaters 22*a* and 22*b*. In addition, a region having a low heat absorption rate among the plurality of regions of the bottom surface of the cooking ware 200 may be placed inside of the cooking compartment to correspond to a region of the reflection device 100 having a high reflectance, or correspond to the heater, which is controlled to have a low output, among the plurality of heaters 22*a* and 22*b*.

Although not shown in the drawings, the plurality of regions of the bottom surface of the cooking ware 200 may be apart from each other with a predetermined interval to prevent thermal conductivity among the plurality of regions. Alternatively, the plurality of regions of the bottom surface of the cooking ware 200 may include a material having a low thermal conductivity, e.g. teflon, ceramic and aerogel, in a space between the regions to prevent the thermal conductivity among the plurality of regions.

As illustrated in FIG. 19, the bottom surface of the cooking ware 200 may be configured to have a different heat absorption rate and the bottom surface of the cooking ware 200 may be configured to cook according to a different cooking recipe, as illustrated in FIG. 20.

For example, as illustrated in FIG. 20, a grill 211 may be installed in any one region of the plurality of regions of the bottom surface of the cooking ware 200 so that a cooking is performed according to a grill cooking method. The grill may be provided to correspond to the size and shape of the region, in which the grill is then installed, and then installed on the corresponding region. The grill may be detachably installed in the corresponding region. When the grill is heated by heat generated by the heater 22, a cooking material placed on the grill may be cooked by the heated grill.

As illustrated in FIG. 20, a water storage space and a supporting unit 213 may be installed in other region of the plurality of regions of the bottom surface of the cooking ware 200 so that a steam-cooking is performed by the steam, wherein the water storage space stores water and the supporting unit 213 is provided on an upper surface of the water storage space to have a large number of holes formed to pass steam therethrough. A cooking material may be placed on the supporting unit 213. When water in the water storage space is heated and then steam is generated, the steam-cooking may be performed on the cooking material placed on the supporting unit 213 by the steam passing through the hole of the supporting unit 213. The supporting unit 213 may be provided to correspond to the size and shape of the region, in which the supporting unit 213 is then installed, and then installed on the corresponding region. In addition, the supporting unit 213 may be detachably installed on the corresponding region.

As illustrated in FIG. 20, the remaining region 215 of the plurality of regions of the bottom surface of the cooking ware 200 may be configured to perform a recipe to cook a cooking material by warming up the cooking material. Unlike the grill cooking and the steam cooking, the region for warming up the cooking material may not need an additional structure. A bottom surface of the region for warming up the cooking material may be implemented by a material having a predetermined heat absorption rate so that warming up the cooking material is efficiently performed.

Figure 21A:
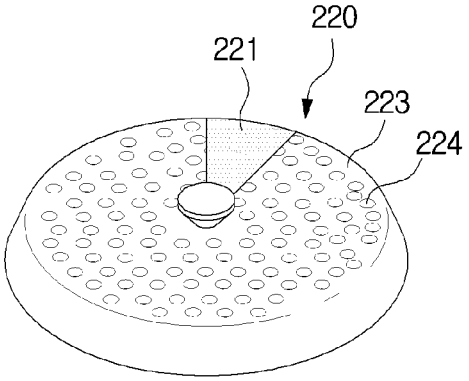
Figure 21B:
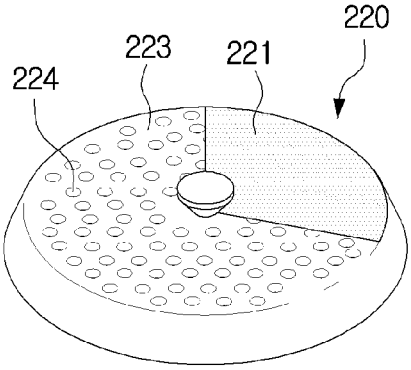
Figure 21C:
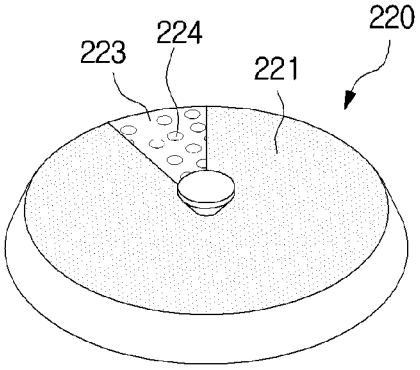
Figure 21D:
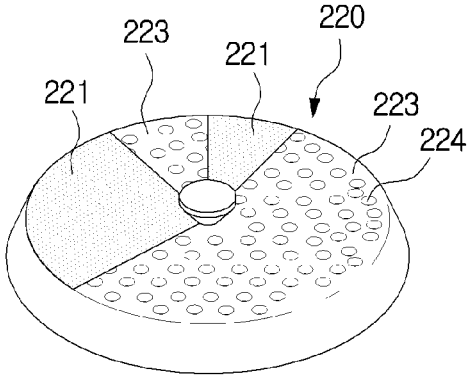

The above mentioned cooking ware 200 may include a lid 220 of the cooking ware 200, which is in a conventional manner and formed of material penetrating electromagnetic waves, wherein the material is one of the material of the cooking ware 200 of the cooking apparatus 1. Alternatively, as illustrated in FIGS. 21A-21D, the lid 220 of the cooking ware 200 may include a first region 221 shielding the electromagnetic waves incident to the lid 220, and a second region 223 in which a large number of hole 224 is provided to penetrate the electromagnetic wave. The lid 220 shown in FIGS. 21A-21D may have a structure similar to the structure of the reflection device 100 shown in FIGS. 10A-10D. The size of the first region 221 and the second region 223 of the lid 220 may be adjustable, as illustrated in FIGS. 21A-21D. That is, as illustrated in FIGS. 21 A to 21C, when the area of the first region 221 is increased, the area of the second region 223 may be reduced as much as the increased area of the first region 221, and in contrast, when the area of the second region 223 is increased, the area of the first region 221 may be reduced as much as the increased area of the second region 223. In addition, as illustrated in FIG. 21D, the first region 221 and the second region 223 may include at least two regions, respectively.

As for the lid 220 shown in FIGS. 21A-21D, the second region 223 may be provided to correspond to the shape of the body 210 of the cooking ware 200 to cover the size of the body 210 of the cooking ware 200. The first region 221 may be configured to be spread or closed like as a fan, on a lower surface or an upper surface of the second region 223 so that the first region 221 is configured to adjust the area of the second region 223. The above mentioned structure is an example, and thus the lid 220 of the cooking ware 200 may be implemented using a variety of structures configured to adjust the area of the first region 221 and the second region 223.

The first region 221 and the second region 223 of the lid 220 of the cooking ware 200 shown in FIGS. 21A-21D may be implemented by galvanized iron, iron, aluminum or copper, and the second region 223 may be formed such that a large number of holes are formed in the above-mentioned materials. In addition, as for the lid 220, the reflectance, absorption, or radiation rate of the heat generated by the heater 22 may be adjusted by a coating process on the above-mentioned materials.

Figure 22:
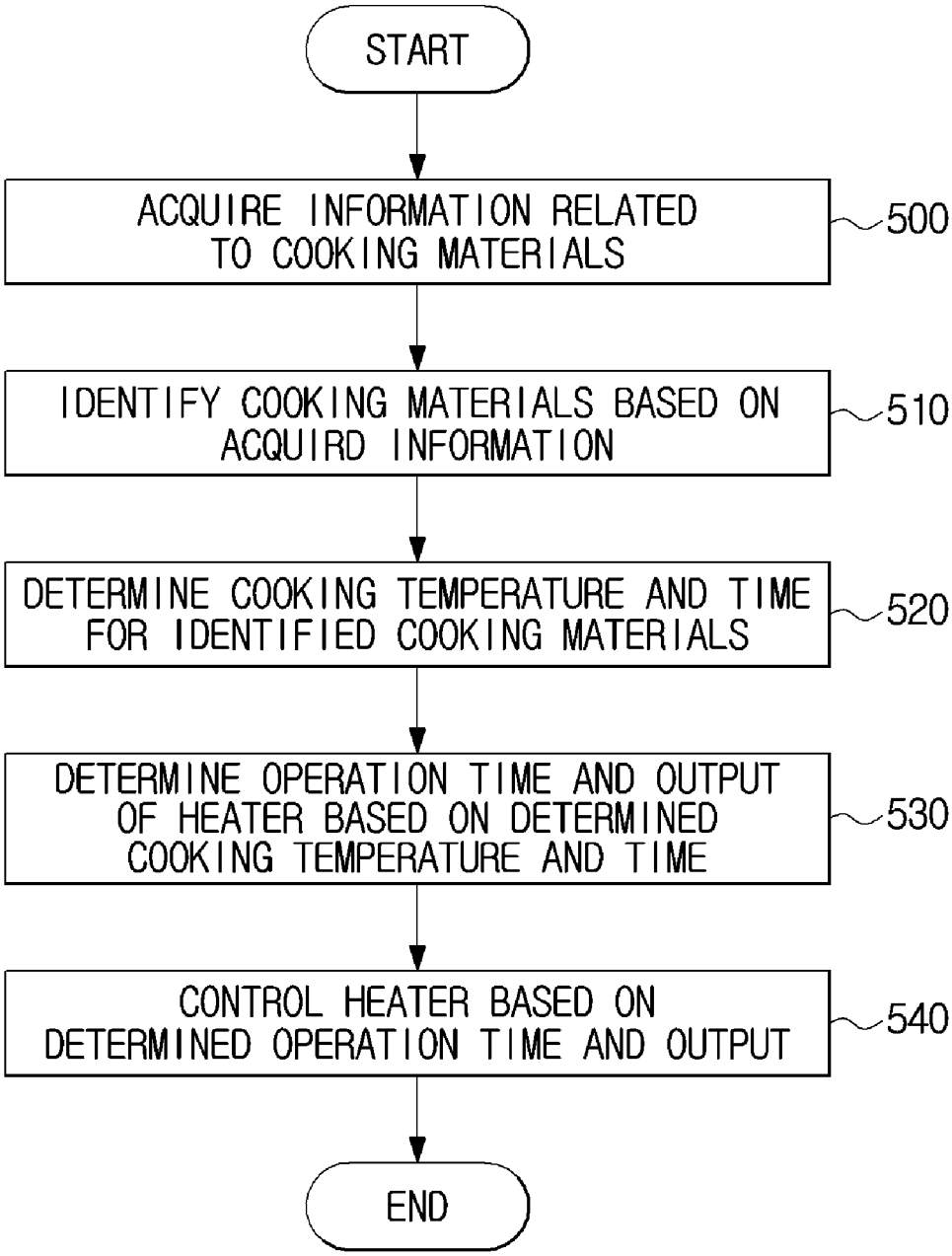
FIGS. 22 and 23 are flowcharts illustrating a control method of the cooking apparatus in accordance with one embodiment.
Figure 23:
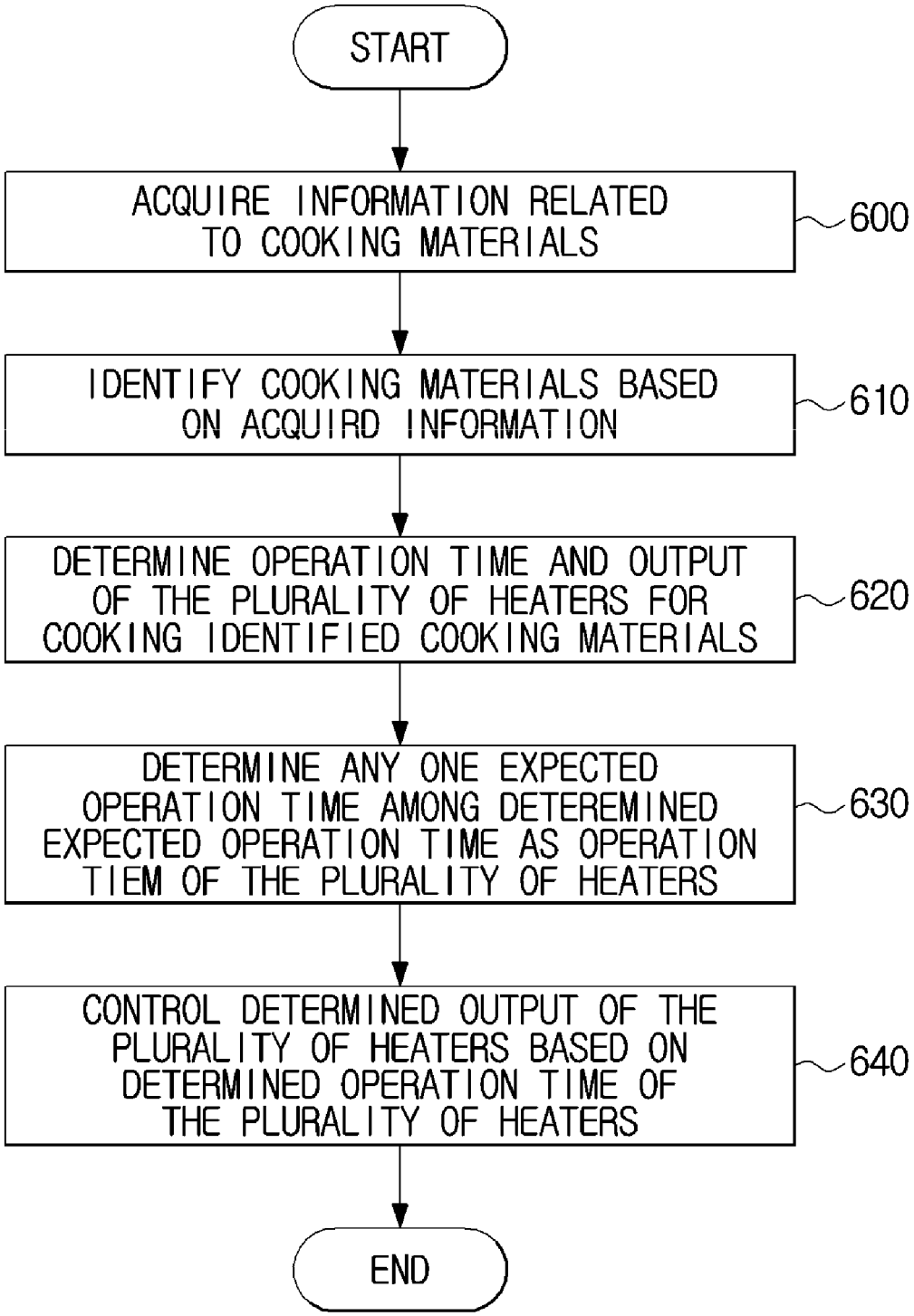

FIGS. 22 and 23 are flowcharts illustrating a control method of the cooking apparatus 1 in accordance with one embodiment. FIG. 22 illustrates a control method of the heater 22 when the heater 22 of the cooking apparatus 1 is single. Referring to FIG. 22, when the sensor 5 of the cooking apparatus 1 acquires information related to the cooking material (500), the controller 150 may identify the cooking material based on the information detected by the sensor 5 (510), and determine a cooking temperature and time required for the identified cooking material (520).

The controller 150 of the cooking apparatus 1 may identify the cooking material based on the information of the cooking material detected by the sensor 5 and determine a cooking temperature and time required for cooking the identified cooking material. The controller 150 may determine the cooking temperature and time required for cooking the identified cooking material by matching cooking data including a predetermined cooking temperature and time according to a cooking material, with the identified cooking material.

The controller 150 may determine an operation time and output of the heater 22 based on the determined cooking temperature and time of the cooking materials (530), and control the operation of the heater 22 based on the determined operation time and output (540).

The controller 150 may determine an operation time and output of the heater 22 based on the cooking temperature and time of the identified cooking materials and the reflectance of the each region of the reflection device 100, and drive the heater 22 based on the determined operation time and output.

For example, the controller 150 may determine the cooking temperature and time of the cooking materials and drive the heater 22 for the determined cooking time so that cooking of the cooking materials is completed at the same time. The controller 150 may determine the longest cooking time between the cooking times of the plurality of cooking materials as an operation time of the heater 22. As for the cooking material requiring a shorter cooking time than the determined operation time of the heater 22, since a cooking time thereof is increased, it may be appropriate that the corresponding cooking material is cooked at a lower cooking temperature than a predetermined cooking temperature. As mentioned above, the controller 150 may adjust the cooking temperature of the plurality of cooking materials based on the determined operation time of the heater 22, and determine an output of the heater 22 by considering the reflectance of the plurality of regions of the reflection device 100 so that the cooking materials are cooked at the adjusted cooking temperature. The controller 150 may control the operation of the heater 22 based on the determined operation time and output of the heater 22.

During cooking the cooking material, when a cooking state of the cooking material is detected by the sensor 5, the controller 150 may appropriately adjust the operation of the heater 22 for the cooking state according to a change in the cooking state of the cooking material. For example, when it is determined that the cooking material is quickly cooked based on an image of the cooking material displayed on an image acquired by the camera, the controller 150 may reduce the output or the operation time of the heater.

FIG. 23 illustrates a control method of the heater 22 when the heater 22 of the cooking apparatus 1 is provided in plural. Referring to FIG. 23, when the sensor 5 of the cooking apparatus 1 acquires information related to the cooking material (600), the controller 150 may identify the cooking material based on the information detected by the sensor 5 (610), and determine an expected operation time and output of the plurality of heaters 22*a* and 22*b* required for cooking the identified cooking material (620).

The controller 150 of the cooking apparatus 1 may identify the cooking material based on the information of the cooking material detected by the sensor 5 and determine a cooking temperature and time required for cooking the identified cooking material. The controller 150 may determine the cooking temperature and time required for cooking the identified cooking material by matching cooking data including a predetermined cooking temperature and time according to a cooking material, with the identified cooking material. The controller 150 may determine an expected operation time and an output of the plurality of heaters 22*a* and 22*b* based on the reflectance of each region of the reflection device 100 and the cooking temperature and time of the identified cooking material, and drive the heater 22 based on the determined expected operation time and output.

For example, the controller 150 may determine the cooking temperature and time of the cooking materials and drive the plurality of heaters 22*a* and 22*b* for the determined cooking time so that cooking of the cooking materials is completed at the same time. That is, when a first cooking time is required to cook the first cooking material (F1), the controller 150 may determine the first cooking time as an expected operation time of the first heater 22*a*, and when a second cooking time is required to cook the second cooking material (F2), the controller 150 may determine the second cooking time as an expected operation time of the second heater 22*b*. When the first cooking time is required to cook the first cooking material (F1), the controller 150 may determine an output (a first output) of the first heater 22*a* based on the first cooking time, and when the second cooking time is required to cook the second cooking material (F2), the controller 150 may determine an output (a second output) of the second heater 22*b* based on the second cooking time.

The controller 150 may determine any one expected operation time among the determined expected time as an operation time of the plurality of heaters 22*a* and 22*b* (630), and adjust the determined output of the plurality of heaters 22*a* and 22*b* based on the determined operation time of the plurality of heaters 22*a* and 22*b* (640).

The controller 150 may determine the longest expected operation time between the expected operation time of the plurality of heaters 22*a* and 22*b* as an expected operation time of the plurality of heaters 22*a* and 22*b*. For example, when the expected operation time of the first heater 22*a* is longer than that of the second heater 22*b*, the controller 150 may determine the expected operation time of the first heater

22*a* as an expected operation time of the first heater 22*a* and the second heater 22*b*. As for the second heater 22*b* having the shorter expected operation time than the determined operation time, since an operation time thereof is increased, it may be appropriate that the second cooking material (F2) cooked by the second heater 22*b* is cooked at a lower cooking temperature than a predetermined second cooking temperature. Therefore, the controller 150 may control an operation of the second heater 22*b* so that the output of the second heater 22*b* is reduced than the second output. In addition, the controller 150 may adjust an output of the second heater 22*b* by considering the reflectance of the region of the reflection device 100 corresponding to the second heater 22*b*.

The controller 150 may determine the shortest expected operation time between the expected operation time of the plurality of heaters 22*a* and 22*b* as an expected operation time of the plurality of heaters 22*a* and 22*b*. For example, when the expected operation time of the second heater 22*b* is shorter than that of the first heater 22*a*, the controller 150 may determine the expected operation time of the second heater 22*b* as an expected operation time of the first heater 22*a* and the second heater 22*b*. As for the first heater 22*a* having the longer expected operation time than the determined operation time, since an operation time thereof is reduced, it may be appropriate that the first cooking material (F1) cooked by the first heater 22*a* is cooked at a higher cooking temperature than a predetermined first cooking temperature. Therefore, the controller 150 may control an operation of the first heater 22*a* so that the output of the first heater 22*a* is increased than the first output. In addition, the controller 150 may adjust an output of the first heater 22*a* by considering the reflectance of the region of the reflection device 100 corresponding to the first heater 22*a*.

The controller 150 may determine an output of the plurality of heaters 22*a* and 22*b* by considering the determined operation time of the heater and the reflectance of the plurality of regions of the reflection device 100, and control the operation of the plurality of heaters 22*a* and 22*b* based on the determined output and operation time of the heater.

During cooking the cooking material, when a cooking state of the cooking material is detected by the sensor 5, the controller 150 may appropriately adjust the operation of the heater for the cooking state according to a change in the cooking state of the cooking material. For example, when it is determined that the cooking material is quickly cooked based on an image of the cooking material displayed on an image acquired by the camera, the controller 150 may reduce the output or the operation time of the heater.

As is apparent from the above description, according to the proposed cooking apparatus and control method thereof, it may be possible to reduce a cooking time since the plurality of cooking materials is cooked at one time.

Since the plurality of cooking materials is cooked at one time, the energy consumption may be reduced in comparison with a case in which the plurality of cooking materials is independently cooked.

Although a few embodiments of the present disclosure have been shown and described, it would be appreciated by those skilled in the art that changes may be made in these embodiments without departing from the principles and spirit of the disclosure, the scope of which is defined in the claims and their equivalents.

DESCRIPTION OF SYMBOLS

22: heater
100: reflection device
125: reflector
R: lower reflection device
200: cooking ware

What is claimed is:

1. A cooking apparatus comprising:
a cooking compartment;
at least one heater configured to emit electromagnetic waves within the cooking compartment; and
a reflection device disposed in the cooking compartment and including coated glass having
a first region having a first reflectance to guide some of the emitted electromagnetic waves toward a first cooking material in the cooking compartment, and
a second region having a second reflectance, being different from the first reflectance, to guide other emitted electromagnetic waves, directed away from the first cooking material, toward a second cooking material in the cooking compartment,
so that the first cooking material is heated at a first temperature in accordance with the first reflectance, while the second cooking material is heated at a second temperature in accordance with the second reflectance by the at least one heater.

2. The cooking apparatus of claim 1, wherein
the reflection device further comprises a reflector provided in a boundary between the first region and the second region to reflect incident electromagnetic waves to reduce interference between electromagnetic waves generated by the heater and passing through the first region and the second region.

3. The cooking apparatus of claim 1, wherein
the reflection device further comprises a reflector in a boundary between the first region and the second region and protruded a predetermined length from a surface of the reflection device that is opposite to a surface of the reflection device facing the at least one heater.

4. The cooking apparatus of claim 1, wherein
the first region and the second region are spaced apart from each other across a separating space,
the reflection device further comprises a reflector protruded a predetermined length from a surface of the reflection device that is opposite to a surface of the reflection device facing the at least one heater, and
the reflector is provided in the separating space to reduce heat conduction between the first region and second region.

5. The cooking apparatus of claim 1, wherein
the reflection device comprises a first coating layer and second coating layer respectively provided in the first region and the second region,
the first coating layer and the second coating layer having different respective reflectance, and
the first coating layer and the second coating layer are provided on at least one of a first surface of the reflection device facing the at least one heater and a second surface of the reflection device opposite to the first surface.

6. The cooking apparatus of claim 1, wherein
the coated glass includes a glass having a varying reflectance in the first region and the second region.

7. The cooking apparatus of claim 1, wherein the coated glass is a lens, the lens having a convex shape on a surface of the lens opposite to a surface of the lens facing the at least one heater.

8. The cooking apparatus of claim 1, further comprising:

a sensor configured to detect a cooking state of the first cooking material and the second cooking material when the first cooking material and the second cooking material are cooked by heat applied via the reflection device, wherein the sensor includes at least one of an infrared sensor to detect a temperature of the first cooking material and the second cooking material, a gas sensor to detect a gas generated in the first cooking material and the second cooking material, and a camera to acquire an image of the first cooking material and the second cooking material.

9. The cooking apparatus of claim 8, further comprising:

a controller configured to control an operation of the at least one heater according to a change in the cooking state detected by the sensor.

10. The cooking apparatus of claim 1, wherein the cooking apparatus comprises a bottom surface to receive the first cooking material and the second cooking material, and the bottom surface of the cooking apparatus comprises a plurality of regions each having a different respective heat absorption rate.

11. The cooking apparatus of claim, 10 wherein the plurality of regions of the bottom surface correspond to the first region and the second region of the reflection device.

12. The cooking apparatus of claim 10, wherein the plurality of regions of the bottom surface are spaced apart from each other to reduce heat conduction therebetween.

13. The cooking apparatus of claim 12, wherein the plurality of regions of the bottom surface are spaced apart from each other by a separating space, and the bottom surface comprises a material, having a lower heat conductivity than that of a material of the plurality of regions, provided in the separating space to reduce heat conduction between the plurality of regions of the bottom surface.

14. The cooking apparatus of claim 1, further comprising:

a lower reflection device provided in a lower side of the bottom surface of the cooking apparatus and provided with a plurality of regions corresponding the plurality of regions of the reflection device, wherein the plurality of regions of the lower reflection device each has a different respective heat reflectance.

* * * * *